US008221589B2

(12) United States Patent
Auranen et al.

(10) Patent No.: US 8,221,589 B2
(45) Date of Patent: Jul. 17, 2012

(54) METHOD, A BLADE HOLDER AND A DOCTOR APPARATUS FOR DETACHING A WEB THREADING TAIL FROM A MOVING SURFACE IN A FIBER WEB MACHINE

(75) Inventors: Tuomo Pekka Auranen, Vaajakoski (FI); Reijo Hassinen, Leppävesi (FI); Veli-Pekka Koljonen, Kärnä (FI); Kari-Matti Laitinen, Jyväskylä (FI); Pekka Meriläinen, Jyväskylä (FI); Anssi Toivanen, Palokka (FI)

(73) Assignee: Metson Paper, Inc., Helsinki (FI)

( * ) Notice: Subject to any disclaimer, the term of this patent is extended or adjusted under 35 U.S.C. 154(b) by 0 days.

(21) Appl. No.: 12/874,663

(22) Filed: Sep. 2, 2010

(65) Prior Publication Data

US 2010/0325912 A1 Dec. 30, 2010

Related U.S. Application Data

(63) Continuation of application No. 12/742,889, filed as application No. PCT/FI2008/050649 on Nov. 11, 2008, now abandoned.

(30) Foreign Application Priority Data

Nov. 14, 2007 (FI) ..... 20075808

(51) Int. Cl.
*B31F 1/12* (2006.01)

(52) U.S. Cl. ..... 162/281; 34/117

(58) Field of Classification Search ..... 162/281, 162/280, 352; 34/117; 15/256.51
See application file for complete search history.

(56) References Cited

U.S. PATENT DOCUMENTS

| | | | |
|---|---|---|---|
| 1,595,478 | A | 8/1926 | Minton |
| 4,014,487 | A | 3/1977 | Reba et al. |
| 5,987,777 | A | 11/1999 | Goebel et al. |
| 6,145,217 | A | 11/2000 | Goebel |

FOREIGN PATENT DOCUMENTS

| | | | |
|---|---|---|---|
| CA | 2144623 | A1 | 3/1995 |
| DD | 3941242 | A1 | 6/1991 |
| EP | 0479748 | A1 | 4/1992 |
| FI | 119389 | | 10/2004 |
| FI | 20030619 | | 10/2004 |
| FI | 20072808 | | 11/2007 |
| GB | 200600 | | 7/1923 |
| WO | 9002225 | A1 | 3/1990 |
| WO | 9723690 | A1 | 7/1997 |
| WO | 2004094723 | A1 | 11/2004 |
| WO | 2009063132 | A1 | 5/2009 |

OTHER PUBLICATIONS

Written Opinion of the International Searching Authority for PCT/FI2008/050649.
International Search Report for PCT/FI2008/050649.

*Primary Examiner* — Mark Halpern
(74) *Attorney, Agent, or Firm* — Stiennon & Stiennon

(57) ABSTRACT

In a method for detaching a web threading tail from a moving surface in a fiber web machine, the web threading tail (12) is detached from a moving surface (23) by means of air that flows from a blow-off blow channel (19) included in a blade holder (14). A trailing blow (26) is directed to the web threading tail (12) using air that flows from a trailing blow channel (17) included in the blade holder (14). The blade holder (14) includes a flow surface (32), and the trailing blow (26) is blown to the same direction with or in a small angle relative to the flow surface (32). The invention also relates to a corresponding blade holder and a doctor apparatus for detaching a web threading tail from a moving surface in a fiber web machine.

22 Claims, 11 Drawing Sheets

METHOD, A BLADE HOLDER AND A DOCTOR APPARATUS FOR DETACHING A WEB THREADING TAIL FROM A MOVING SURFACE IN A FIBER WEB MACHINE

CROSS REFERENCES TO RELATED APPLICATIONS

This application is a continuation of U.S. application Ser. No. 12/742,889, filed May 13, 2010, the disclosure of which is hereby incorporated by reference, which was a U.S. national stage application of International App. No. PCT/FI2008/050649, filed Nov. 11, 2008, the disclosure of which is incorporated by reference herein, and claims priority on Finnish App. No. 20075808 filed Nov. 14, 2007.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for detaching a web threading tail from a moving surface in a fiber web machine. The invention also relates to a corresponding blade holder and a doctor apparatus.

Various tail threading constructions are known in the prior art. Of these, publications EP 0479748 and WO 97/23690 are mentioned here. Publication EP 0479748 proposes detachment of a web threading tail with an air blow, more precisely with a blow-off air blow. In addition to detachment of a web threading tail, publication WO 90/02225 proposes blowing of a web threading tail into contact with a fabric by means of trailing blows. With these systems, a web threading tail can be detached from a roll surface and blown into contact with the fabric with trailing blow means. Trailing blows are difficult to orientate. In addition, the effect of trailing blows is of a short duration. On the other hand, the blow-off blow created by the blow-off air and the trailing blow created by the trailing air disturb each other.

SUMMARY OF THE INVENTION

An object of the invention is to provide a novel method which avoids the above mentioned problems and can be used to guide the web threading tail more accurately and over a longer distance. The characteristic features of this invention are that

- a web threading tail is detached from a moving surface using air that flows from a blow-off blow channel included in a blade holder,
- a trailing blow is directed to the web threading tail using air that flows from a trailing blow channel included in the blade holder,
- the blade holder includes a flow surface, and the trailing blow is blown parallel with or in a small angle relative to the flow surface.

Another object of the invention is to provide a novel blade holder which can be used to guide a web threading tail as desired even over a relatively long distance. The characteristic features of this invention are that the blade holder frame includes

- a blow-off blow channel with air flowing therefrom being adapted to generate a blow-off blow for detaching a web threading tail from a moving surface in a fiber web machine,

- a trailing blow channel with air flowing therefrom being adapted to generate a trailing blow for guiding the web threading tail further, and
- a flow surface relative to which the trailing blow is adapted to flow parallel with or in a small angle.

Still another object of the invention is to provide a novel doctor apparatus which allows guiding a web more extensively than before. The characteristic features of this invention are that the blade holder frame includes

- a blow-off blow channel with air flowing therefrom being adapted to generate a blow-off blow for detaching a web threading tail from a moving surface in a fiber web machine,
- a trailing blow channel with air flowing therefrom being adapted to generate a trailing blow for guiding the web threading tail further, and
- a flow surface relative to which the trailing blow is adapted to flow parallel with or in a small angle.

A web threading tail formed from a web is guided in a fiber web machine for threading the web. The web refers to board and paper webs. In turn, the web forming machine refers to fiber web machines used for producing paper or board. In the method, a web threading tail is detached from a moving surface in a fiber web machine. More precisely, a web threading tail is detached from a moving surface using air that flows from a blow-off blow channel included in a blade holder. A trailing blow is directed to the web threading tail using air that flows from a trailing blow channel included in the blade holder. The blade holder includes a flow surface, and the trailing blow is blown parallel with or in a small angle relative to the flow surface. Web threading to one or more machine sections of a fiber web machine is performed using a narrow web threading tail. The sections can be a dryer section, a calender and a coating station, for example. Once threading is successfully carried out, the narrow web threading tail is widened to the full width for starting the production. The web threading tail is detached from a moving surface with release means for the web threading tail. The moving surface can be, for example, a roll surface or a cylinder surface. Doctoring can be performed using merely air, but a mechanical doctor can be used along with air doctoring. In case a combination of air doctoring, i.e. an air blade, and mechanical doctoring, i.e. a mechanical blade, is used for detaching the web threading tail, the air blade, i.e. a blow-off blow, is located before the mechanical blade in the rotation direction of a roll. The blow-off blow is oriented against the tail travel direction and directed near to the contact point of the mechanical blade and the roll surface. Thus an air blade is typically sufficient for detaching the web threading tail from the vicinity of a moving surface whereby a mechanical blade serves as backup. In other words, the web threading tail is in contact with the moving surface from which it is detached with an air blow. The mechanical blade is used to detach the web threading tail from the moving surface if the tail is still attached to the moving surface at the mechanical blade. Trailing blow means are used to direct a trailing blow to the web threading tail. In other words, air is blow with the trailing blow means towards the travel direction of the web threading tail whereby a trailing blow is generated. Blowing air towards the travel direction of the web threading tail means that the trailing blow has a component that is directed to the travel direction of the tail. The blade holder includes a flow surface, and the trailing blow means are used to blow the trailing blow parallel with or in a small angle relative to the flow surface. In other words, the trailing blow means are used to blow air substantially parallel with the flow surface included in the blade holder. A flow surface refers to a surface to the direction of which web guiding is started. The flow surface is a part of the blade holder; for example, a surface of a flow deflector included in the blade holder or directly a surface of the blade holder. Thus, in the vicinity of, i.e. beside the flow surface, a so-called Coanda effect is created in which the blown air is bent conforming to the surface by the internal viscosity. The flow surface is thus a surface in the vicinity of which the trailing blow creates a flow conforming to the Coanda effect. Furthermore, air conforming to the surface guides the web. Thus the web does not contact the blade holder, but, on the other hand, the web can be controllably guided over a long distance. In other words, blowing occurs substantially parallel with the flow surface, i.e. to the same direction or in a small angle relative to the flow surface, when a guiding flow is created in the vicinity of the flow surface utilizing a Coanda effect for guiding the web threading tail.

In an embodiment, the trailing blow is blown parallel with or in a small angle relative to the flow surface in two different positions. In other words, air is blown substantially parallel with the travel direction of the web threading tail, i.e. to the same direction or in a small angle relative to the flow surface, in two positions. There may be more than two positions. Two positions from which air is blown enable creating a Coanda effect over a longer distance in the vicinity of, i.e. beside the flow surface. In addition, multiple positions in the web travel direction enable multiple pressure zones in the web travel direction whereby web guiding is more accurate than before.

In another embodiment, the blade holder is turned around the pivot point and the pivot point is in the web travel direction, after the first trailing blow channel. In case of multiple trailing blow channels, a trailing blow channel is preferably between trailing blow channels. When the blade holder is turned relative to such a pivot point which is located after the first trailing blow channel in the web travel direction or between trailing blow channels, very controllable turning is achieved. In addition, the blade holder can then be located in very many different positions.

In a third embodiment, pressure lower than the environment is created between the blow-off blow and the trailing blow. A lower pressure is generated when air flowing from the blow-off blow channel and air discharging from the trailing blow channel both draw air ejector-like from the zone between the blow-off blow and the trailing blow.

In a fourth embodiment, a mechanical blade is loaded with a presser means. In addition, a blow-off blow comes from the vicinity of the presser means for detaching a web threading tail from a moving surface. In other words, a blow-off blow comes from the presser means or passing by one of its surfaces. Then the blow-off blow is in contact with the presser means. In this case, the release means for the web threading tail include an air blade and a mechanical blade that are set very close to each other. Additionally, the blow-off blow can be directed accurately to the desired location since the presser means extends close to the tip of the mechanical blade.

In a fifth embodiment, a blow-off blow comes from a presser means for detaching a web threading tail from a moving surface.

When the blow-off blow comes from within a presser means, it is possible to use a standard blade, i.e. a conventional mechanical blade. In this way an advantageous entirety is achieved as regards costs. In this embodiment, fewer separate components are needed than before.

In a sixth embodiment, a trailing blow comes from a presser means substantially parallel with the flow surface. The trailing blow coming from a presser means enables guiding the web threading tail even earlier. In this case the web threading tail is guided with the trailing blow in very close vicinity to the tip of the mechanical blade.

In a seventh embodiment, the doctor apparatus includes a mechanical blade. The presser means loading the mechanical blade is a presser plate. In addition, a blow-off blow comes from between the mechanical blade and the presser plate for detaching a web threading tail from a moving surface. This embodiment enables using a relatively thin presser plate creating a blow-off blow in connection with the mechanical blade. In other words, a blow-off blow goes beside the mechanical blade. In this case, air flows from between the mechanical blade and the presser plate. The entirety includes both a mechanical blade and an air blade. With air blowing from between the mechanical blade and the presser plate, the air flow can be directed precisely to the desired point. With air blowing from between the mechanical blade and the presser plate, a construction external to the blade holder, which disturbs the travel of the web threading tail past the flow surface, is also avoided.

BRIEF DESCRIPTION OF THE DRAWINGS

The invention is described below in detail by making reference to the enclosed drawings, which illustrate some of the embodiments of the invention.

DESCRIPTION OF THE PREFERRED EMBODIMENTS

Figure 1A:
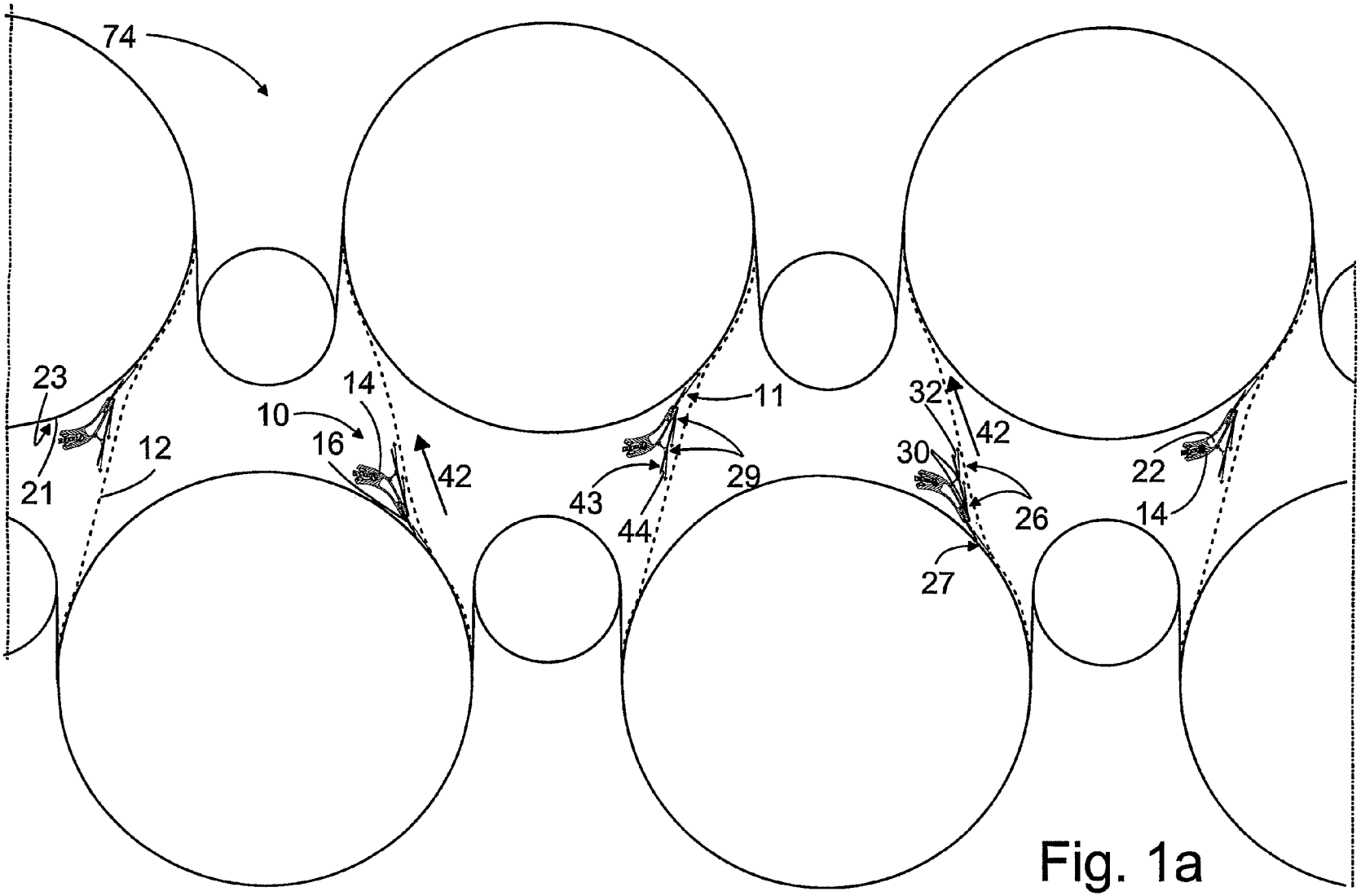
FIG. 1*a* shows a doctor apparatus according to the invention in connection with a double-fabric run.
Figure 1B:
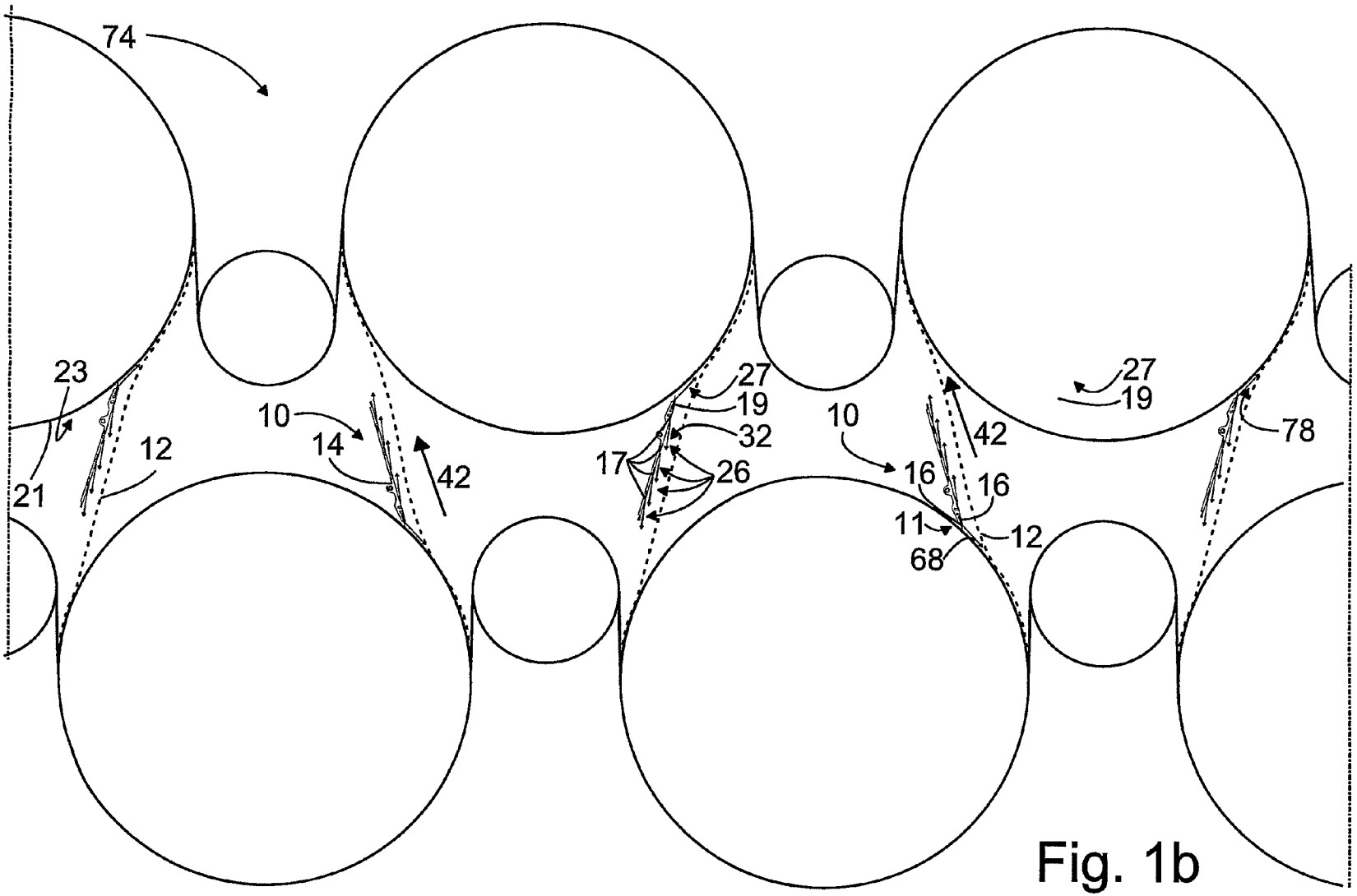
FIG. 1*b* shows the doctor apparatus according to the invention in connection with a double-fabric run.

FIGS. 1*a* and 1*b* shows a doctor apparatus 10 according to the invention for detaching a web threading tail from a moving surface in a fiber web machine. The doctor apparatus 10 includes an adjustable blade holder 14. The blade holder 14 has a frame 71, shown in FIG. 2*a*. Air comes from the blade holder frame creating a blow-off blow 27, shown in FIG. 1*a* for detaching a web threading tail 12 from a moving surface 23 in a fiber web machine. Air also comes out of the blade holder frame creating a trailing blow 26 to guide the web threading tail 12 further. The turning blade holder 14 includes a flow surface 32 relative to which the trailing blow 26 is adapted to flow parallel with or in a small angle. When the turning blade holder includes a flow surface, the flow surface turns with the blade holder.

FIG. 1*a* shows a doctor apparatus 10 according to the invention in a dryer section of a fiber web machine in connection with a double fabric run 74. The doctor apparatus 10 is used to detach a web threading tail 12 from a moving surface 23 in the fiber web machine. The doctor apparatus 10 includes release means 11 for the web threading tail 12 and trailing blow means 29. The release means 11 are used to detach the web threading tail 12 formed out of the web from the moving surface 23, which is typically a roll surface or a cylinder surface 21. The trailing blow means 29 are adapted to form a trailing blow 26. In addition, the doctor apparatus 10 includes a flow surface 32, and the trailing blow means 29 are so directed that the trailing blow 26 generated by these is adapted to flow substantially parallel with the flow surface 32. With air flowing parallel with the flow surface, the doctor apparatus can guide the web threading tail and transport it further assisted by a Coanda effect.

The doctor apparatus 10 shown in FIG. 1*a* includes release means 11 for the web threading tail 12 and trailing blow means 29. The trailing blow means 29 consist of a nozzle channel assembly formed by nozzle channels 30. From the nozzle channel 30, air is adapted to flow to generate a trailing blow 26 headed to the travel direction 42 of the web threading tail 12.

The trailing blow means 29, more precisely the nozzle channels 30, are adapted to generate a trailing blow which is substantially parallel with the flow surface 32. The release means included in the doctor apparatus shown in FIG. 1*a* include a mechanical blade 16 and a blow channel for generating a blow-off blow 27. The purpose of the blow-off blow 27 is to detach the web threading tail. If the web threading tail is allowed to travel until to the mechanical blade, the mechanical blade will detach the web threading tail.

In the doctor apparatuses according to the invention shown in FIG. 1*a*, the flow surface 32 is a surface 44 of a separate flow deflector 43. Thus the flow surface can be formed in a desired location irrespective of the blade holder position. Moreover, the fastening position of the blade holder can be freely selected.

In the doctor apparatuses 10 shown in FIG. 1*a*, an air channel 22 is included within the blade holder 14. When the air channel is placed within the blade holder, the air channel is protected against impurities. In other words, the air channel does not form a profile in the blade holder which would collect dirt. When the blade holder is of a composite material, an air channel can be formed inside the blade holder already during the manufacturing stage, in which case the entirety is simple to manufacture.

FIG. 1*b* shows a doctor apparatus 10 in a dryer section of a fiber web machine for detaching a web threading tail 12 from a moving surface 23. The doctor apparatus 10 includes an adjustable blade holder 14. By the adjustability of a blade holder, it is referred to that the blade holder can be turned and thus loaded relative to the moving surface included in a dryer section, typically relative to a cylinder included in a dryer section. In addition, the blade holder 14 further includes a blow-off blow channel 19, a trailing blow channel 17 and a flow surface 32. More precisely, the blade holder includes a blow-off blow channel 19 with air flowing therefrom being adapted to generate a blow-off blow 27 for detaching the web threading tail 12 from a moving surface 23 in a fiber web forming machine. A blade holder is used here extensively to refer to blade holders in which the blade can be an air blade or an air blade combined with a mechanical blade. An air blade or an air doctor is used to doctor off a web threading tail from a moving surface. The trailing blow channel 17 included in the blade holder is a trailing blow channel 17 with air flowing therefrom being adapted to generate a trailing blow 26 for guiding the web threading tail 12 further. The flow surface 32 included in the blade holder 14 is a flow surface 32 relative to which the trailing blow 26 is adapted to flow parallel with or in a small angle, i.e. substantially to the same direction.

In the doctor apparatus 10 shown in FIG. 1*b*, more precisely in the blade holder 14, trailing blow means 29 are located in two positions in the travel direction 42 of the web threading tail 12. This embodiment is particularly advantageous in connection with a double-fabric run 74, in which the web threading tail must be guided for a long distance separated from the fabric.

FIG. 1*b* shows a section of a double-fabric run 74 in connection with which a doctor apparatus 10 according to the invention is advantageously used. The release means 11 for the web threading tail 12 included in the doctor apparatus 10 are a combination of an air blade 68 and a mechanical blade 16. Thus the air blade 68 formed by the blow-off blow 27 coming from the blow channel, i.e. the release blow channel 19, is located in the travel direction 42 of the web threading tail 12 prior to the mechanical blade 16. Typically an air blade is sufficient for detaching the web threading tail from the vicinity of a roll surface. The air blade 68 formed by the blow-off blow 27 coming from the air-blow channel 38 is directed towards an opening nip 78 between the web and the roll surface.

Figures 2A, 2B:
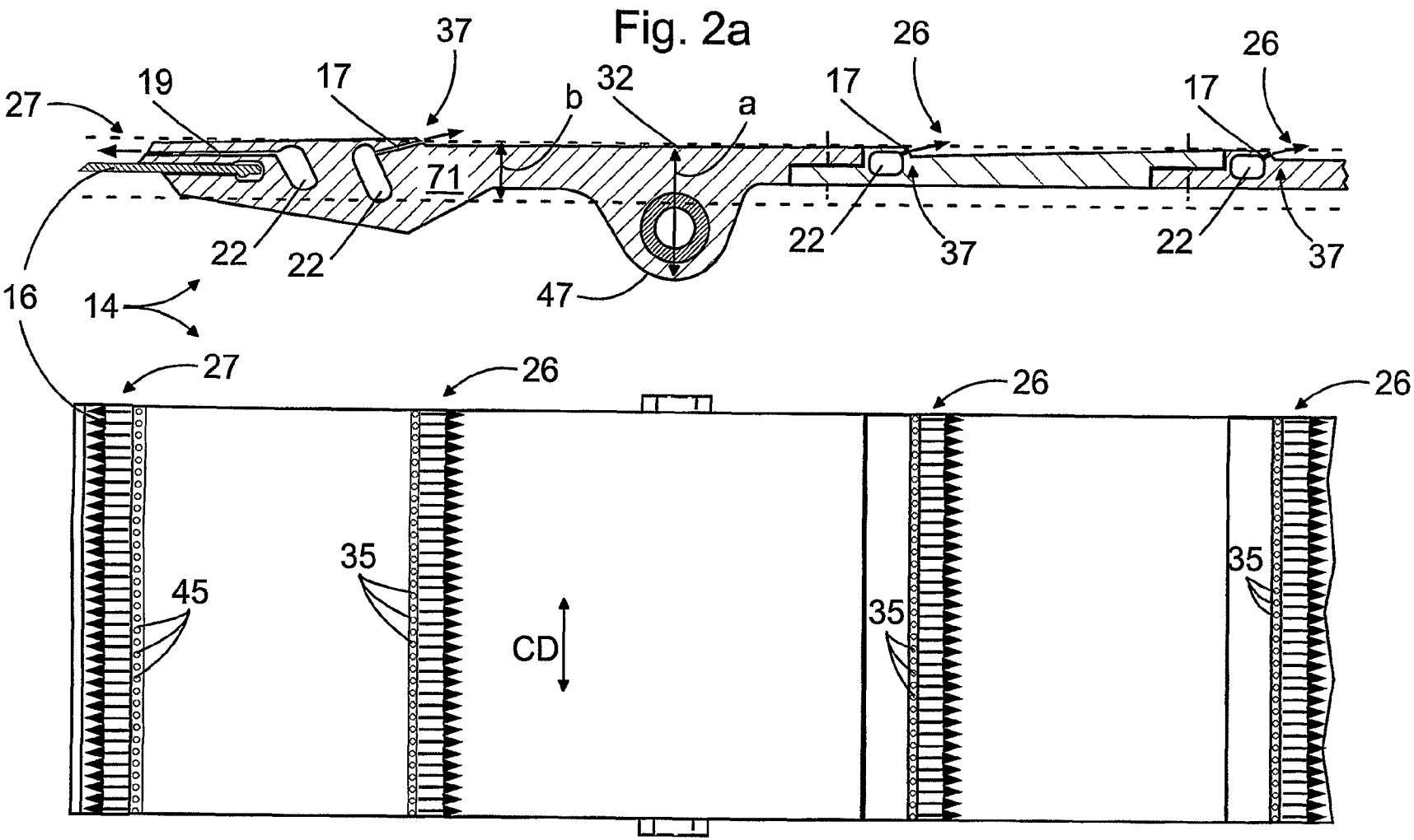
FIG. 2*a* is a side view of a blade holder according to the invention.
FIG. 2*b* is a top view of a blade holder according to the invention.

FIG. 2*a* shows a blade holder 14 according to the invention for a fiber web machine, seen from the side of the blade holder. The blade holder 14 includes a frame 71. In addition, the frame 71 of the blade holder 14 includes a blow-off blow channel 19, a trailing blow channel 17, and a flow surface 32. Air blowing out from the blow-off blow channel 19 is adapted to generate a blow-off blow 27 for detaching a web threading tail from a moving surface in a fiber web machine. Air blowing out from the trailing blow channel 17 is adapted to generate a trailing blow 26 for guiding the web threading tail further. The trailing blow 26 is adapted to flow parallel with or in a small angle relative to the flow surface 32. When the blade holder frame includes a blow-off blow channel, a trailing blow channel and a flow surface, a compact entirety for guiding a web threading tail is achieved. This compact application can be very freely located in many positions in a fiber web machine.

The blow-off blow channels 19 included in the blade holder 14 shown in FIG. 2*a* open to a surface of the blade holder as blow-off blow openings 45, which are visible in FIG. 2*b*. Correspondingly, the trailing blow channels 17 included in the blade holder 14 shown in FIG. 2*a* open to a surface of the blade holder as trailing blow openings 35, which are visible in FIG. 2*b*. The blade holder also includes air channels 22, from which air is guided further to the blow-off blow channels and the trailing blow channels. The air channels 22 are continuous in the cross-direction (CD) of the blade holder 14, which is also the cross-direction of the fiber web machine. The trailing blow channels, in turn, which open to a surface of the blade holder as trailing blow openings, are separate in the cross-direction. Correspondingly, the blow-off blow channels, which open to a surface of the blade holder as blow-off blow openings, are separate in the cross-direction. Both the trailing blow channels and the blow-off blow channels can be manufactured by drilling. Generally, it can be stated that the blade holder of FIG. 2*a* is shown in FIG. 2*b* from another direction.

As shown in FIG. 2*a*, the flow surface 32 is flat. Advantageously, the height of the trailing blow openings 35 in the flat flow surface 32 is over 50%, advantageously over 70% of the height of an air-blow shoulder 37 provided in the flow surface 32. Except for the air-blow shoulders, the flow surface is flat excluding minimal surface differences due to the material and the manufacturing method. As such, the air blow surface can curve for guiding a web threading tail as desired. However, the flow surface is advantageously substantially straight as shown in FIG. 2*a*.

Figures 2C, 2D:
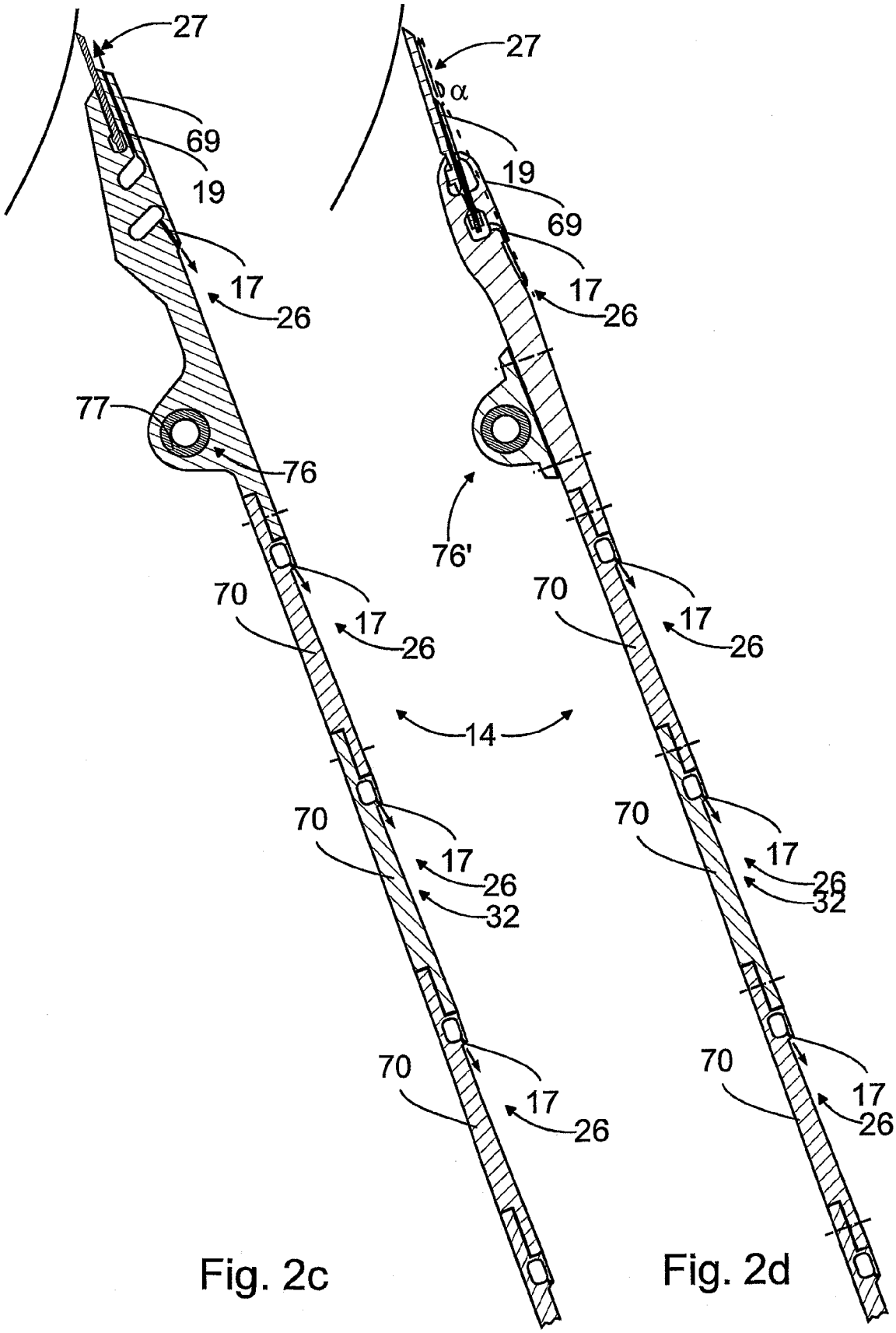
FIG. 2*c* is a side view of a blade holder according to the invention.
FIG. 2*d* is a side view of a blade holder according to the invention.

FIGS. 2*c* and 2*d* show a blade holder according to the invention having a flow surface 32 and further a blade holder 14 that include several flow supports 70 connected to each other. In other words, the flow surface 32 is composed of several flow supports 70 which are connected to each other. Flow supports that are connectable to each other enable forming a flow surface with a desired length in connection with a standard main component even during the installation.

The flow support 70 included in the blade holder 14 shown in FIGS. 2*c* and 2*d* has a trailing blow channel 17 with air flowing therefrom being adapted to generate a trailing blow 26 for guiding the web threading tail further. When the flow surface is composed of several flow supports with trailing blow channels, a notably long flow surface can be assembled from the flow supports for guiding the web threading tail. A required number of flow supports are thus connectable to the blade holder whereby a flow surface of a desired length can be formed in the blade holder. When the flow supports are provided with trailing blow channels, the flow remains intensive even in connection with a long flow surface assembled from flow supports. Thus the web threading tail can be guided as desired also for a long distance.

In the blade holders shown in FIGS. 2*c* and 2*d*, trailing blow channels 17 are located in two positions in the travel direction of the web threading tail. Several trailing blows enable guiding the web over a long distance without the blow weakening.

In the blade holder shown in FIGS. 2*c* and 2*d*, a guide surface 69 is included between the blow-off blow 27 and the trailing blow 26. A vacuum is created in connection with the guide surface or a vacuum surface, since there are blows with a different direction along both of its sides. As the blow-off blow 27 and the trailing blow convey air ejector-like to the relative directions, a depressurized guiding surface is created between them. For maintaining the vacuum or the pressure drop, the guide surface must be substantially flat. Advantageously, the guide surface is straight or almost straight. When the guide surface is flat, the pressure will not escape as described above, and the web will not bump into projections in the surface. Thus a flat surface cannot have pipes or similar projections.

In the blade holder according to the invention shown in FIGS. 2*c* and 2*d*, the angle $\alpha$ between the blow-off blow 27 and the trailing blow 26 is over 130°, advantageously over 150°. Thus the blow-off blow and the trailing blow enable both detaching the web threading tail from a moving surface and guiding the tail forward as desired. For example, the angle can be a straight angle 180°. When the blade holder is straight, considering also the flow surface portion of the blade holder, the maximum angle is typically 200°, advantageously 190°. The angle can exceed 180 degrees even in connection with a straight blade holder since the blow-off blow can be directed towards the mechanical blade. With mechanical blades, conventional doctor blades are referred to, in which the doctoring result is based on a mechanical contact. Another example of an angle exceeding 180 degrees is in the condition of FIGS. 4 and 5 where the flat flow surface becomes curved. In these figures the angle is between 180° and 190°. In connection with a curving surface, the angle as such can exceed 200°, being for example 220°.

In FIG. 2*d*, the fastening position 76 of the shaft 77 is a detachable fastening position 76', a part of the blade holder. The fastening position includes fastening positions for bolts, for example, by which the fastening position can be connected to the rest of the blade holder. Such an embodiment enables connecting different fastening positions for shafts in the same main component of a blade holder.

Figure 2E:
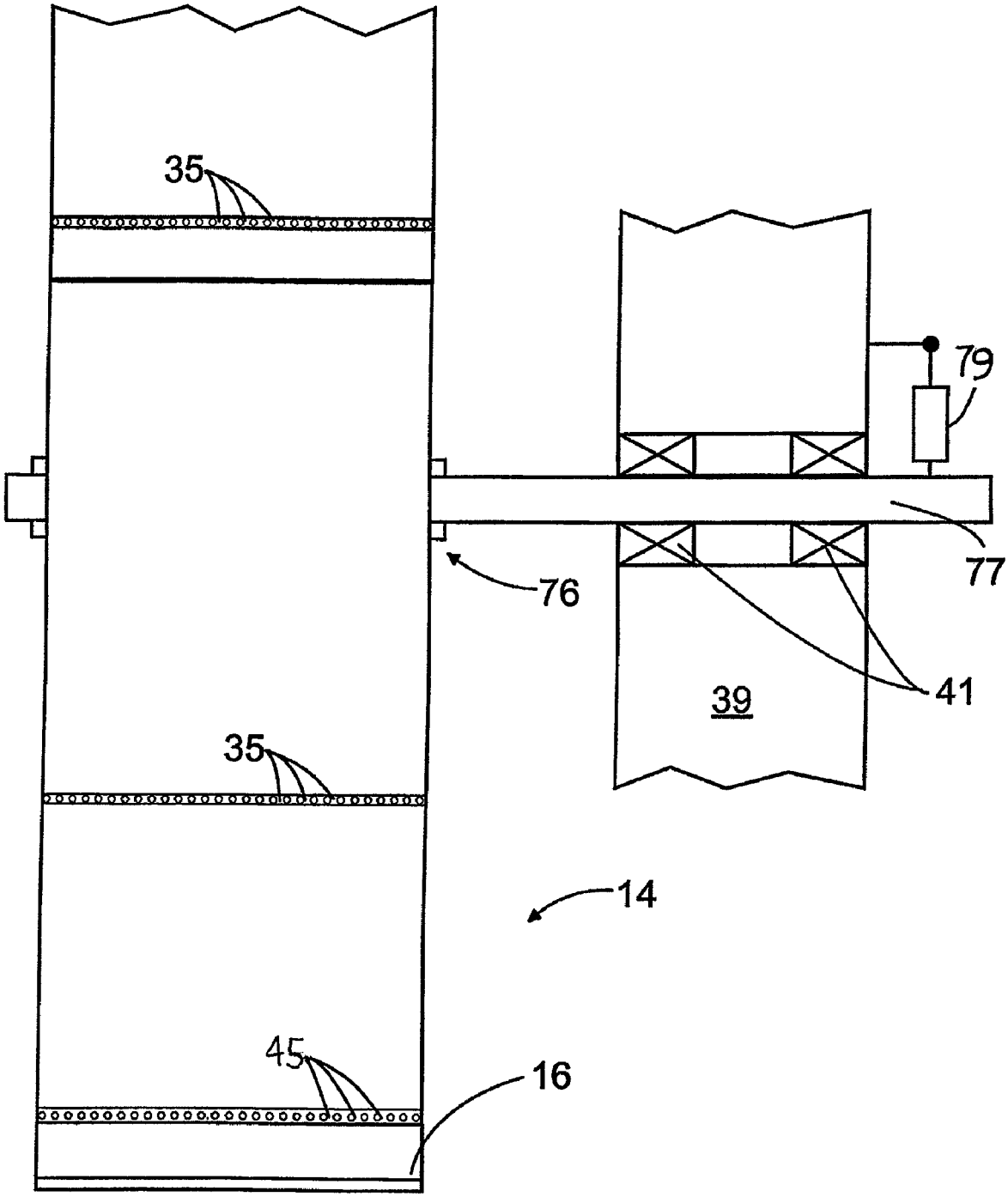
FIG. 2*e* shows a blade holder according to the invention supported to the frame of a fiber web machine.

FIG. 2*e* shows a blade holder 14 according to the invention including a fastening position 76 for a shaft 77. The shaft 77 and further the blade holder 14 are turned with a turning actuator 79. The turning actuator can be, as known in prior art, a pneumatic cylinder or a hydraulic cylinder, for example. The shaft thus functions as a bracket with which the blade holder turns. The shaft is fastened to the frame component 39 of the fiber web machine via bearings 41. In other words, the shaft is mounted with bearings to turn in a fiber web machine and to keep in place in the blade holder. Without a bearing assembly between the blade holder and the shaft, the blade holder can be very thin at the shaft as well. Even more essential is that loading the blade holder via the shaft is simple. Moreover, the cylinder can be taken out from between moving surfaces, i.e. cylinders.

Generally, it can be stated that a blade holder refers to a construction which becomes an air blade. In addition, the blade holder can have a mechanical blade connected thereto. The thickness of the blade holder is below 100 mm, advantageously below 80 mm, which is shown in FIG. 2*a*. Such a thickness enables locating the blade holder in very many places. The thickness of the blade holder refers to the maximum thickness of the blade holder, i.e. the maximum distance between the flow surface 32 and the background surface 47. In addition, the average thickness b of the blade holder 14 is below 90, advantageously below 70 mm. The doctor of FIG. 3*a* has correspondingly a thickness a and an average thickness b. In addition, the doctor of FIG. 3*a* is curved over its surface although the surface as such is flat.

The blade holder 14 shown in FIG. 2 is made of an aluminum profile 75. The construction of the aluminum profile is shown in more detail in the combination of FIGS. 2*a* and 2*b*. Generally, the blade holder is of solid aluminum excluding the cross-directional air channels and machine-directional bores for air-blows formed during casting. In addition, cut-outs have been made in the aluminum profile for a mechanical blade, for example. A cross-directional hole is also provided for a shaft. In addition, holes and cut-outs can be provided for connecting flow supports to each other, for example. Air channels 22 can be relatively small since they are completely sufficient for conveying the required volume of air. Generally, the flow surface including a desired number of flow supports is very flat and straight, i.e. linear. Associated with the flow surface, there are after all trailing blows for leading the web threading tail forward as desired. The required reinforcement materials can be located on the bottom surface of the blade holder, i.e. on the opposite side of the blade holder relative to the flow surface. With this embodiment, a very low blade holder construction is also achieved.

Figure 3A:
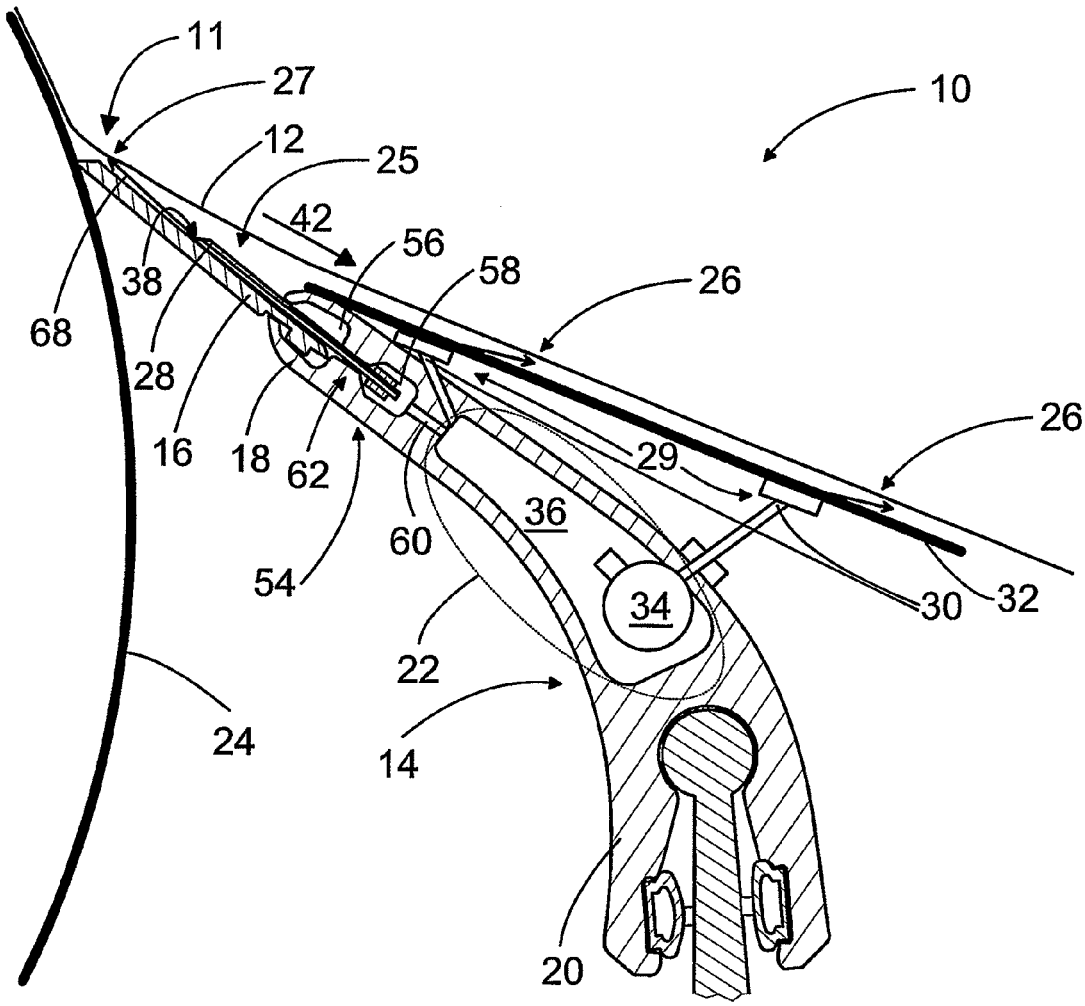
FIG. 3*a* shows a doctor apparatus according to the invention.

FIG. 3*a* shows a doctor apparatus 10 according to the invention including a blade holder 14, release means 11 for a web threading tail 12, and a nozzle channel 30. The release means 11 include a mechanical blade 16 and an air blade 68 formed by a blow-off blow 27. The blade holder 14 has a first end 18 and a second end 20. The transportable web threading tail 12 travels past the doctor apparatus 10 away from the first end 18 of the blade holder 14. The mechanical blade 16 or a doctor blade is fastened to the vicinity of the first end 18 of the blade holder 14. More precisely, the nozzle channel 30 for generating a trailing blow 26 is in connection with the blade holder 14. More precisely, the nozzle channel 30 is inside the blade holder. In addition, the nozzle channel 30 is so oriented that the air blown therefrom is adapted to flow parallel with or in a small angle relative to a flow surface 32 included in the doctor apparatus 10. In other words, the doctor apparatus 10 also includes a flow surface 32 relative to which the trailing blow 26 is blown substantially parallel with. Thus the trailing blow 26 flows away from the first end 18 of the blade holder 14. Flows that are substantially parallel with the flow surface create a Coanda effect in the vicinity of the flow surface.

In the doctor apparatus according to the invention shown in FIG. 3*a*, trailing blow means 29 are provided in two positions in the travel direction 42 of the web threading tail 12. More precisely, there are two nozzle channels 30 in the travel direction 42 of the web threading tail 12. Having trailing blow means in two positions enables creating a Coanda effect over a longer distance in the vicinity of the flow surface 32.

In the doctor apparatus shown in FIG. 3*a*, the blade holder 14 is provided with an internal air channel 22 in the longitudinal direction of a blade holder 14 and a mechanical blade 16, i.e. in the cross-direction of the fiber web machine. Advantageously, the air channel 22 is divided into a first pressure channel 34 and a second pressure channel 36. Such an embodiment can be achieved, for example, when one channel has been formed in the blade holder during extrusion with a pipe placed therein later for forming the second pressure channel. Two pressure channels in the longitudinal direction of the blade holder enable modifying flow parameters easily as one whole in the travel direction of the web threading tail. In other words, pressure levels and flows from the nozzle channels can be made as desired. Thus flow parameters can be adjusted to different settings in the travel direction of the web threading tail. A nozzle channel that is earlier in the travel direction of the web threading tail has thus different flow parameters than a later nozzle channel.

A doctor apparatus in which the trailing blow is oriented parallel with the flow surface can be used at the full web width when guiding the web to a pulper, for example. On the other hand, the trailing blow can be as narrow as the web threading tail. Although the trailing blow would be only as wide as the web threading tail, the air channel can have the same length as the blade holder.

The doctor apparatus 10 according to the invention shown in FIG. 3*a* includes a presser means 25 for loading a mechanical blade 16. In addition, associated with the presser means 25, there is an air-blow channel 38 for generating a blow-off blow 27. When the air-blow channel is associated with the presser means, the air-blow channel can be inside the presser means or on the surface of the presser means. An air-blow channel 38 associated with the pressure means 25 enables orienting the air-blow precisely. Advantageously, the presser means is a removable presser plate 28 and the air-blow channel 38 is included between the presser plate 28 and the mechanical blade 16. Thus air flows from between the mechanical blade 16 and the presser plate 28 generating the blow-off blow 27 for detaching a web threading tail 12 from a roll surface 24. In this way the flow direction of air can be better oriented to a desired point. With constructions inside the presser means, external constructions are avoided which can become soiled and unnecessarily affect the tail travel. In the figure, the mechanical blade is shown wear-free.

In the doctor apparatus 10 according to the invention shown in FIG. 3*a*, the blade holder 14 includes a blade groove 54 to which a mechanical blade 16 is connected. In addition, flow openings 60 are provided between the blade groove 54 and the air channel 22 for leading air from the air channel 22 to the blade groove 54. In this way, it is possible to lead pressurized air, which can be utilized further as desired, to the vicinity of the entirety formed by the mechanical blade and the presser plate.

Figure 3B:
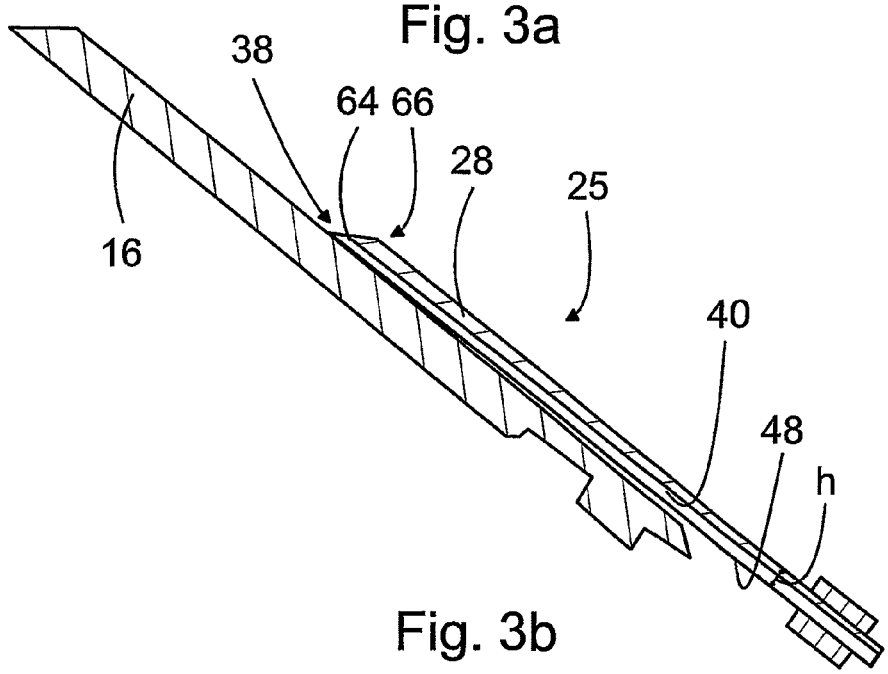
FIG. 3*b* shows a mechanical blade with a presser plate used in a doctor apparatus according to the invention.

FIG. 3*b* shows a mechanical blade 16 used in a doctor apparatus according to the invention provided with a presser means 25, which is a presser plate 28. An air-blow channel 38 is provided between the presser plate 28 and the mechanical blade 16. Advantageously, the surface 48 on the side of the mechanical blade 16 of the presser plate 28 includes an air-blow groove 40 for creating the air-blow channel 38. There are several air-blow grooves in the longitudinal direction of the mechanical blade. The presser plate 28 extends within the blade holder 14 further than the mechanical blade 16, and the blade groove 54 includes a front part 56 and a rear part 58 (FIG. 3*a*). Advantageously, a groove 62 for the presser plate 28 is provided between the front part 56 and the rear part 58. When the rear part 58 or the blade groove 54 is pressurized, air flows in the presser plate 28 from the rear part 58 of the blade groove 54 to between the mechanical blade 16 and the presser plate 28.

The presser plate 28 shown in FIG. 3*b* is provided with an air-blow groove 40 having a tip 64 at the edge 66 of the presser plate 28 butting the mechanical blade 16. In addition, the air-blow groove 40 narrows in the thickness direction h of the presser plate 28 towards its tip 64. Thus air flows in such a way that its movement is directed partly towards the mechanical blade. With the movement directed partly towards the mechanical blade, air bounces back from the mechanical blade whereby the movement direction of the rebounced air is towards the opening nip as desired (FIG. 1*b*).

Figure 4:
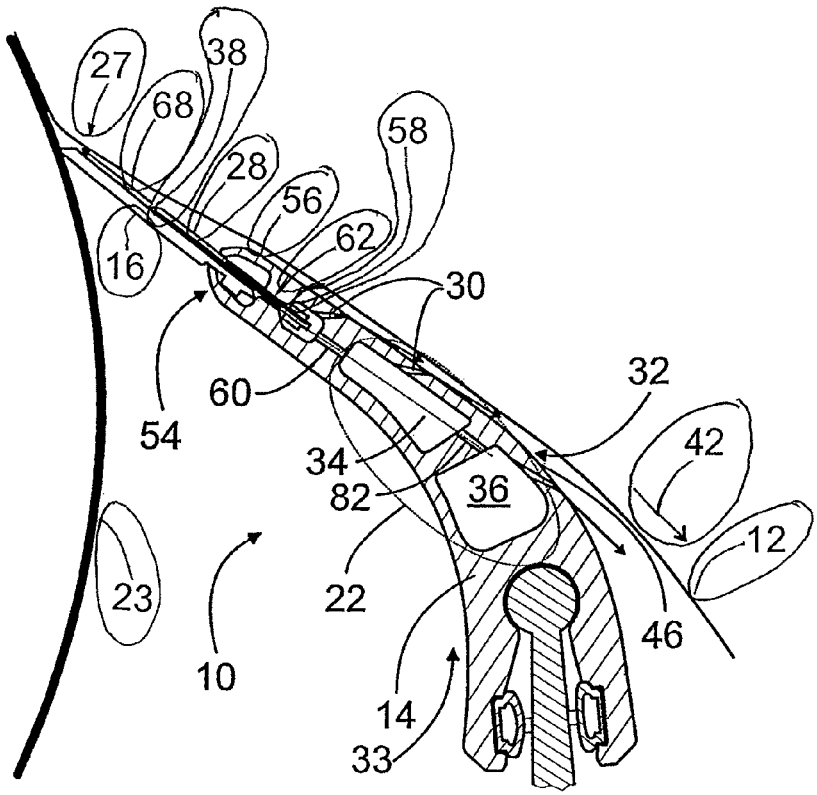
FIG. 4 shows another doctor apparatus according to the invention.

FIG. 4 shows another doctor apparatus 10 according to the invention 10. In this doctor apparatus 10 the flow surface 32 is a surface 46 of the blade holder 14. The flow surface 46 is composed of several flow zones that are formed at the end of each nozzle channel 30. The shape of the flow surface can be, for example, curved. When the flow surface is a surface of the blade holder, the mass of the doctor apparatus can be reduced compared to an application provided with a flow deflector. The size of the doctor apparatus can also be smaller when the number of required components is smaller. Then the doctor apparatus is easy to locate in many applications.

The doctor apparatus 10 of FIG. 4 has an adjustable blade holder 14. The blade holder has a frame formed as a single integral piece. The blade holder 14 has an air channel 22 comprised of a first pressure chamber 34 and a second pressure chamber 36 connected by a flow channel 82. A further flow opening 60 connects the first pressure chamber to a first presser plate chamber 58 in which a presser plate 28 is mounted which extends through a groove and flow channel 62 into a second presser plate chamber 56 in which a mechanical doctor blade 16 is mounted. When the doctor blade 16 is positioned against a moving surface 23 in order to detach a web threading tail 12 from the moving surface 23 a portion of the presser plate 28, as shown in FIG. 3*b*, forms a smooth continuous flow surface 32 over which the web threading tail travels as the web leaves the moving surface. The detachment of the web from the moving surface 23 is assisted by an air blow shown by arrow 68 and coming from the air-blow channel 38 formed between the doctor blade 16 and the presser plate 28 as shown in FIG. 3*b* and is directed towards an opening nip between the web 12 and the roll surface 23. A plurality of nozzle channels 30 extend into each of the first presser plate chamber 58, the first pressure chamber 34, or the second pressure chamber 36. Each of the plurality of nozzle channels 30 are aligned in a direction which forms an acute angle with respect to a portion of the flow surface 32 which the nozzle channel joins, the direction is away from the direction indicated by the arrow 68. Air flowing through the plurality of holes 30 guides the web threading tail 12 along the direction of travel 42 of the web threading tail 12 over the flow surface 32. The portion of the surface 32 which each nozzle channel 30 joins is smoothly continuous or planer except for the actual opening of the nozzle channel 30 through the flow surface 32.

Figure 5:
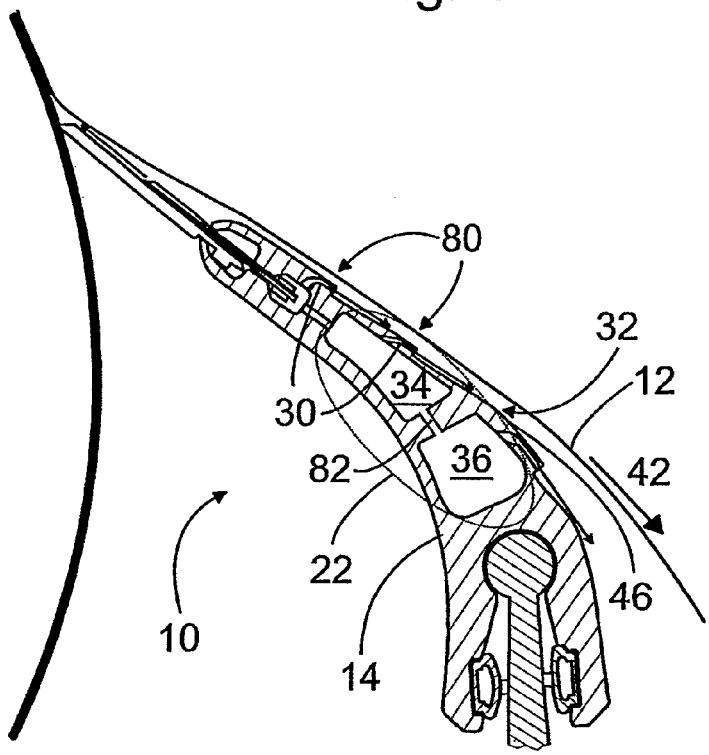
FIG. 5 shows a third doctor apparatus according to the invention.

FIG. 5 shows a third doctor apparatus 10 according to the invention. In this doctor apparatus 10 the flow surface 32 is a surface 46 of the blade holder 14. Projections 80 are formed on the surface 46 of the blade holder 14 at the nozzle channels 30. In this way the flow can be guided towards the surface. In addition, the web threading tail cannot bump into the air-blow channels.

In the doctor apparatuses shown in FIG. 5, there are three nozzle channels 30 in the travel direction 42 of the web threading tail 12. Thus, in connection with a flow surface, the web can be controlled over a long distance.

In the doctor apparatuses shown in FIGS. 4 and 5, the air channel 22 located within the blade holder 14, in the longitudinal direction of the blade holder 14 is divided into a first pressure channel 34 and a second pressure channel 36. The pressure channels 34, 36 are connected by a flow channel 82. The pressure channels 34, 36 are manufactured directly to the frame material of the blade holder whereby a simple constructional complex is achieved.

In FIG. 4, the flow channel 82 between the pressure channels 34 and 36 is a flow channel assembly manufactured by drilling. Drilling is performed through the blade groove 54. Flow openings 60 are drilled at the same time. In turn in FIG. 5, the flow channel 82 between the pressure channels 34 and 36 is a groove manufactured during casting.

Figure 6:
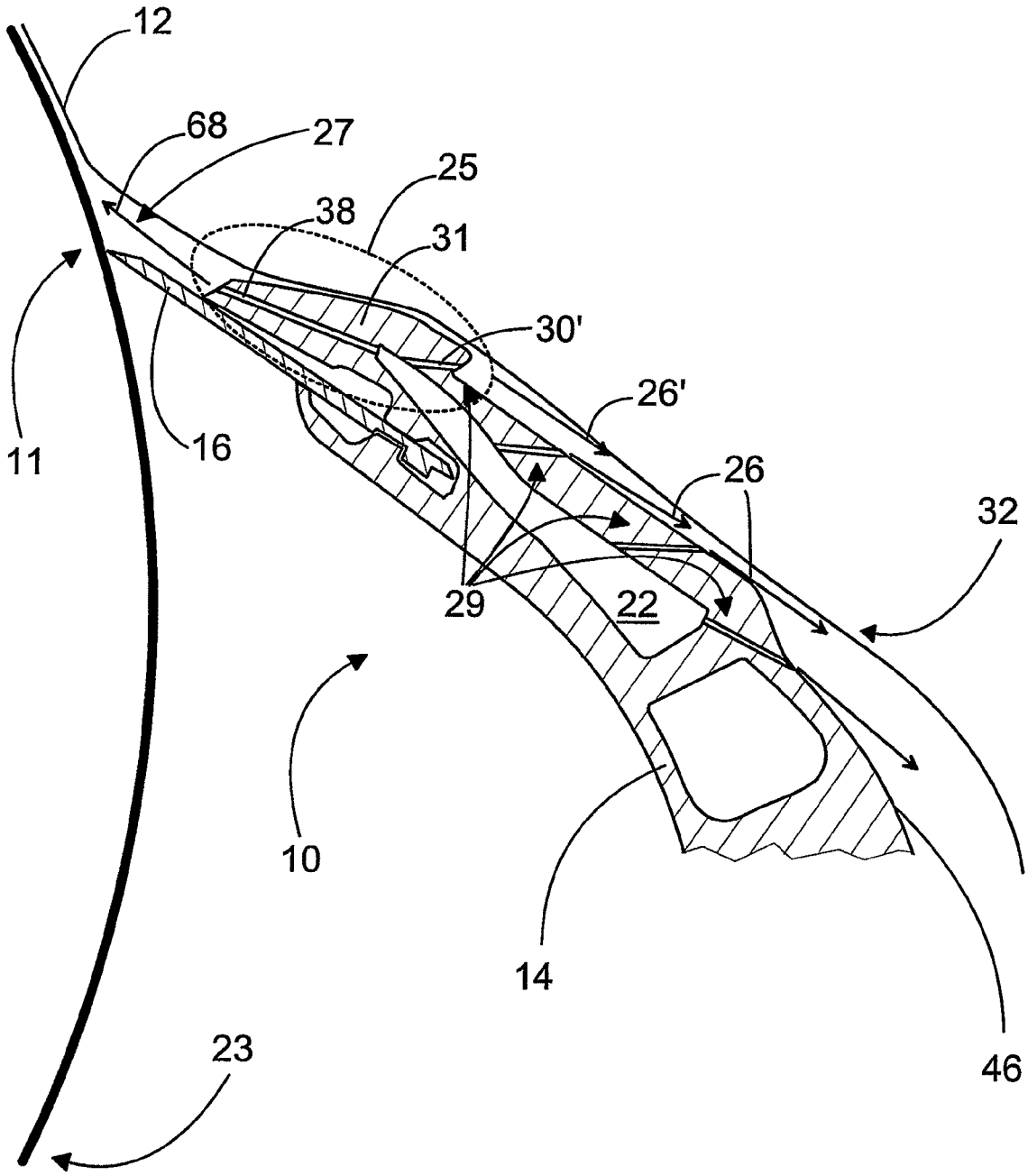
FIG. 6 shows a fourth doctor apparatus according to the invention.

The doctor apparatus 10 shown in FIG. 6 includes release means 11 for the web threading tail 12 and trailing blow means 29 which are adapted to generate a trailing blow 26. The release means 11 for the web threading tail consist of a mechanical blade 16 and an air blade 68, which is formed by a blow-off blow 27. The purpose of the blow-off blow 27 is to detach the web threading tail 12 from a moving surface 23. The trailing blow 26 generated by the trailing blow means 29 is adapted to flow to the direction of the flow surface 32. The flow surface 32 is a surface 46 of the blade holder. The blade holder 14 has within it an air channel 22 with the trailing blow means 29 departing therefrom forming the nozzle channels 30.

The doctor apparatus 10 shown in FIG. 6 includes a presser means 25 for loading the mechanical blade 16. In addition, associated with the presser means 25, there is an air-blow channel 38 for generating a blow-off blow 27. When the blow-off blow 27 is created via an air-blow channel 38 associated with the presser means 25, the blow-off blow 27 can be directed near to the tip of the mechanical blade 16 in a desired angle.

In the doctor apparatus shown in FIG. 6, the presser means 25 includes a nozzle channel 30' for generating a trailing blow 26'. A presser means refers to a construction that loads the mechanical blade and extends over at least a part of the mechanical blade dimension, typically over the dimension of the mechanical blade. Then the nozzle channel is already beside the mechanical blade whereby the detached web threading tail can be taken into control with the trailing blow faster than before.

In the doctor apparatus shown in FIG. 6, the presser means 25 is integrated as a part of the blade holder 14. Thus the presser means is an integrated presser construction 31. An integrated presser construction enables leading air to the vicinity of the mechanical blade in a simple way. The air channel 22 can then extend as a part of the integrated presser construction 31. The air channel extends over the entire length of the blade holder, but the nozzle channels and air-blow channels departing from it are holes. The air channel is typically formed when forming the blade holder by extrusion or pultrusion, for example. The nozzle channels and the air-blow channel, in turn, are made by drilling, for example.

Figure 7:
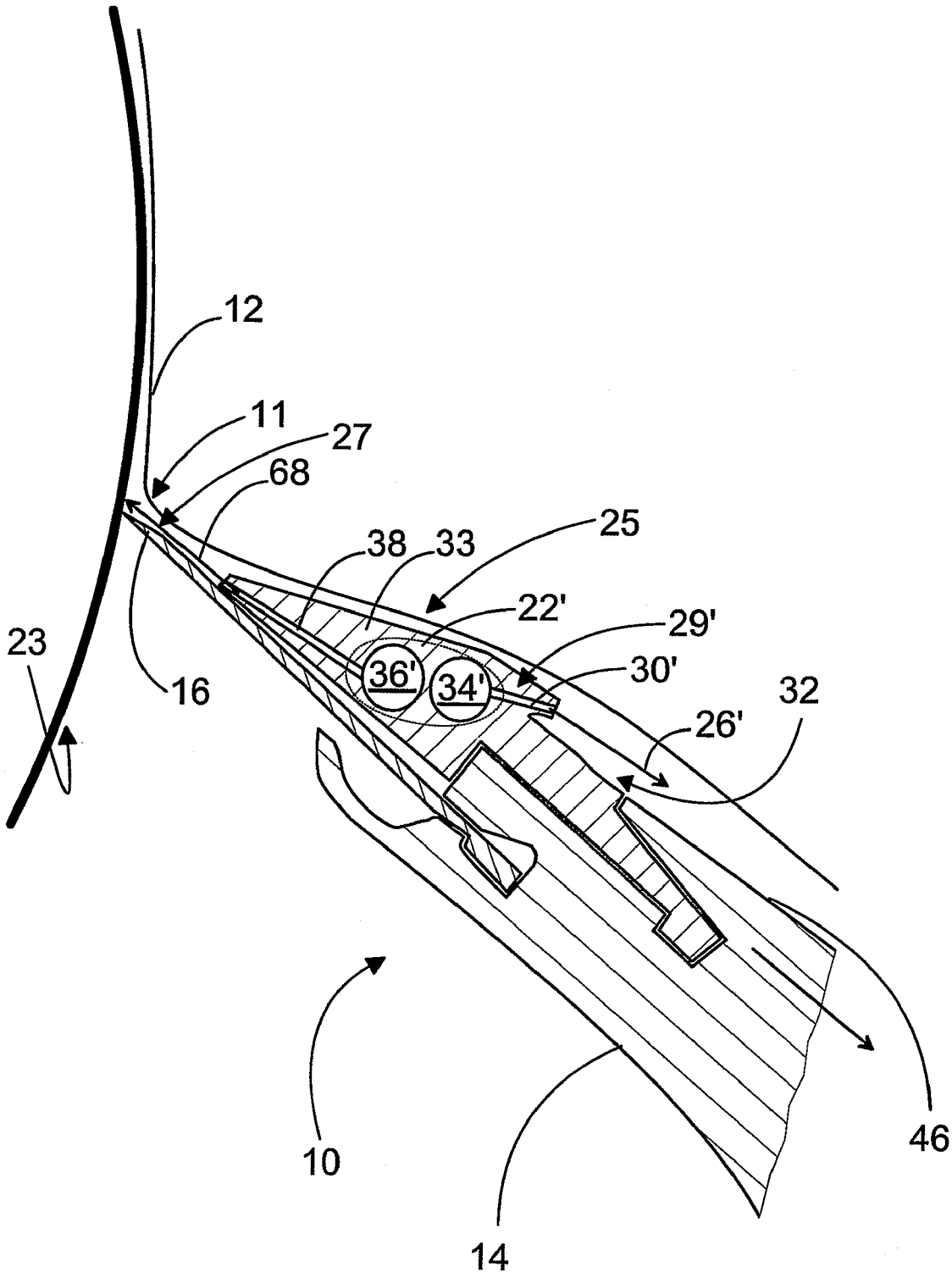
FIG. 7 shows a fifth doctor apparatus according to the invention.

The doctor apparatus 10 shown in FIG. 7 includes release means 11 for the web threading tail 12 and trailing blow means 29 which are adapted to generate a trailing blow 26. The release means 11 for the web threading tail include a mechanical blade 16 and an air blade 68 formed by a blow-off blow 27. The trailing blow 26 generated by the trailing blow means 29 is adapted to flow to the direction of the flow surface 32, which is a surface 46 of the blade holder. The flow surface 32 is a surface 46 of the blade holder. The presser means 25 has within it air channels 22' departing from which there are nozzle channels 30' of the presser device 25 formed by the trailing blow means 29' located in the presser device 25. Associated with the presser means 25, there is also an air-blow channel 38 for generating a blow-off blow 27. The air-blow channel may be a continuous slit in the cross-direction of the fiber web machine or it may consist of several separate holes. When a blow-off blow 27 is created via an air-blow channel 38 associated with a presser means 25, the blow-off blow 27 can be directed as desired. The presser means forms the upper jaw of the blade holder with which the blade is loaded as desired. The blade is supported by the lower jaw of the blade holder further away from the blade tip, which is used to doctor the moving surface.

The flow surface starts immediately when the trailing blow discharges from the nozzle channel. A flow area is provided after each nozzle channel. The flow surface consists of one or more flow areas. The length of one flow area depends on the pressure level and design, but typically the length of one flow area is at least 30 cm, advantageously 20 cm. When there are several nozzle channels, there are several flow areas as well. The flow areas form together flow surfaces that can be relatively long and possibly with a varying shape. The flow surface can, for example, bend over its distance.

The presser means 25 shown in FIG. 7 is a removable presser means 33. A removable presser means can be replaced when it damages without the need to replace the blade holder as a whole. A combination of a presser means and a blade holder can also be made more resistant when they are not connected by an air channel. A removable presser means 33 has a sufficient cross-sectional area for forming the required air channels 22' in it. A removable presser means includes a nozzle channel 30' for directing a trailing blow 26' substantially parallel with the flow surface 32 included in the doctor apparatus 10.

In the doctor apparatus shown in FIG. 7, the air channels 22' are composed of two separate pressure channels 34', 36'. A nozzle channel 30' departs from the first pressure channel 34' in the removable presser means 33. In turn, an air-blow channel 38 departs from the second pressure channel 36' in the removable presser means 33 for generating a blow-off blow.

The presser means can consist of several presser components that are separate from each other. A presser means consisting of several components can be very similar to the one in FIG. 7, but a presser plate is included in the presser means as a second presser component.

From the presser means shown in FIG. 7, an embodiment can be manufactured in which the presser means is integrated as a part of the blade holder. The presser means can be as in FIG. 7, but an integral part of the blade holder.

The presser means 25 according to FIG. 7 provided with an air-blow channel 38 can extend over the entire dimension of the blade or it can be only in the tail threading area, which is typically 50-80 cm in width. If a presser means with air-blow channels extends only to the tail threading area, a conventional presser plate, for example, is used elsewhere. The material of both the blade holder and the presser means is typically fiber-reinforced plastic.

Figure 8:
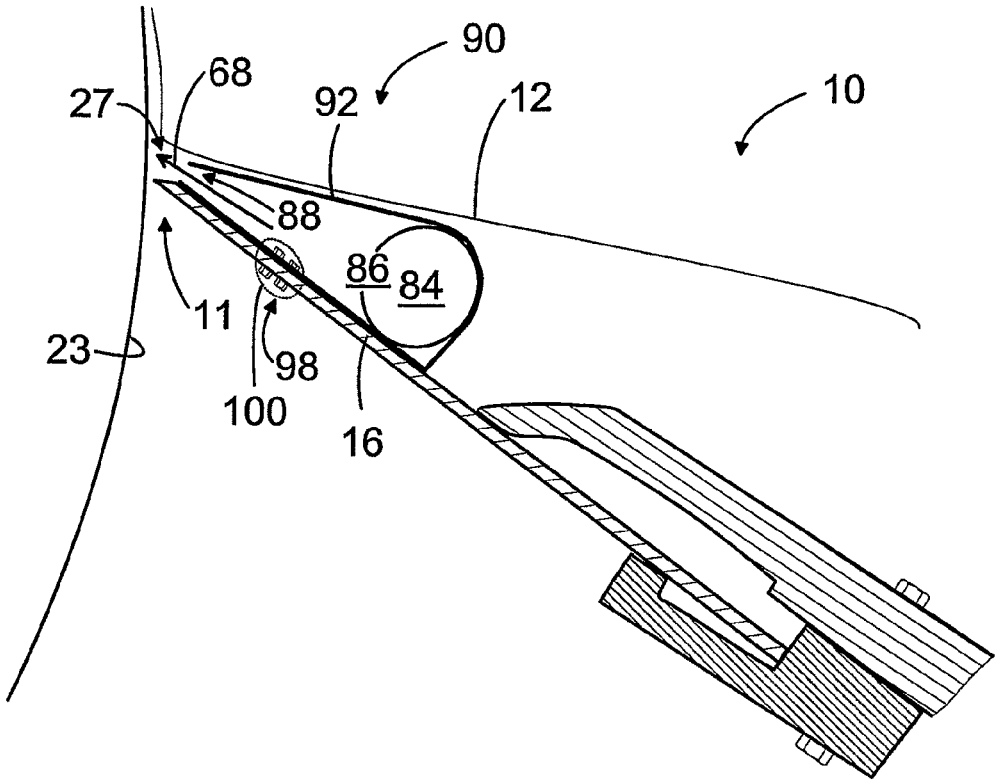
FIG. 8 shows a slit nozzle casing in connection with a mechanical blade.

FIG. 8 shows a doctor apparatus 10 having a slit nozzle casing 90 in connection with the mechanical blade 16. The mechanical blade 16 is included in the release means 11 for a web threading tail 12 which are used to detach a web threading tail 12 from a moving surface 23 in a fiber web machine. Besides the mechanical blade 16, the release means 11 for the web threading tail 12 include an air blade 68. The purpose of the air blade 68 is to detach the web threading tail 12 from a moving surface 23, i.e. by providing an air-blow with the blow-off blow 27. The slit nozzle casing 90 includes a first wall 92 or a cover surface. The blow-off blow 27 passes through a blow-off blow slit 88 located between the first wall 92 and the mechanical blade 16. The slit nozzle casing enables generating a blow-off blow as desired in connection with the mechanical blade without a presser means. When the slit nozzle casing is a separate construction, the slit nozzle casing can be used in connection with several blades. More generally, the release means 11 included in the doctor apparatus include a mechanical blade 16. In addition, the doctor apparatus 10 includes a slit nozzle casing 90 having a first wall 92 and a blow-off blow slit 88 between the first wall 92 and the mechanical blade 16.

In the doctor apparatus shown in FIG. 8, a mechanical blade 16 is removably fastened to a slit nozzle casing 90. In other words, a separate slit nozzle casing 90 is fastened to the mechanical blade 16 with an openable connection 98. The connection being an openable connection, the mechanical blade can be replaced allowing thereby to use the slit nozzle casing in connection with several blades. Gluing or otherwise integrating the device as an integral part of the mechanical blade is not advantageous because then the replaceability of the casing from one mechanical blade to another will be lost and changes are produced in the behavior of the mechanical blade in an air-blow situation. In case the mechanical blade would be integrated as a part of the slit nozzle casing, the mechanical blade would yield in an air-blow condition. The openable connection 98 is advantageously a bolted connection 100, which is implementable in a simple way. When using a bolted connection, the slit nozzle casing can be continuous.

Such an openable connection can also be contemplated which is a form closure connection. A form closure connection enables replacing the mechanical blade more easily than a bolted connection. When using a form closure connection, the mechanical blade can be replaced by pushing the blade in place to the blade holder after which the slit nozzle casing is pushed in place to the vicinity of the mechanical blade. A problem with a form closure connection is the sufficiency of space beside a fiber web machine, since the slit nozzle casing is a rigid construction.

In an embodiment in which the counter air-blow does not come from within the blade holder, a slit nozzle casing is provided in connection with a mechanical blade. The slit nozzle casing includes a first wall. In other words, a slit nozzle casing is fastened to the mechanical blade. A blow-off blow passes through a blow-off blow slit located between the first wall and the mechanical blade. The slit nozzle casing enables forming the blow-off blow slit very close to the tip of the mechanical blade since the first wall of the slit nozzle casing, i.e. the cover surface, can extend very close to the tip of the mechanical blade by which the moving surface is doctored.

In another embodiment in which the counter air-blow does not come from within the blade holder, the blow-off blow slit opens when the gap between the mechanical blade and the first wall is pressurized. In other words, the blow-off blow slit is closed in the unpressurized state. When the blow-off blow slit is open only in the pressurized state; the blow-off blow slit does not get soiled as much as a blow-off blow slit that remains open all the time.

Generally, the release means include a mechanical blade. In addition, a slit nozzle casing with a first wall is provided in connection with the mechanical blade. A blow-off blow passes through a blow-off blow slit located between the first wall and the mechanical blade. Advantageously, the blow-off blow slit opens when the gap between the mechanical blade and the first wall is pressurized.

In the doctor apparatus shown in FIG. 8, the blow-off blow slit 88 opens when the gap between the mechanical blade 16 and the first wall 92 is pressurized. The blow-off blow slit is then not in the unpressurized state and the blow-off blow slit can thus not get soiled in the unpressurized state.

In the doctor apparatus shown in FIG. 8, a pipe 84 is provided within the slit nozzle casing 90 for leading air to the slit nozzle casing 90. The pipe has an opening 86 for leading air from the pipe 84 to the slit nozzle casing 90 and for pressurizing the slit nozzle casing 90.

Figure 9:
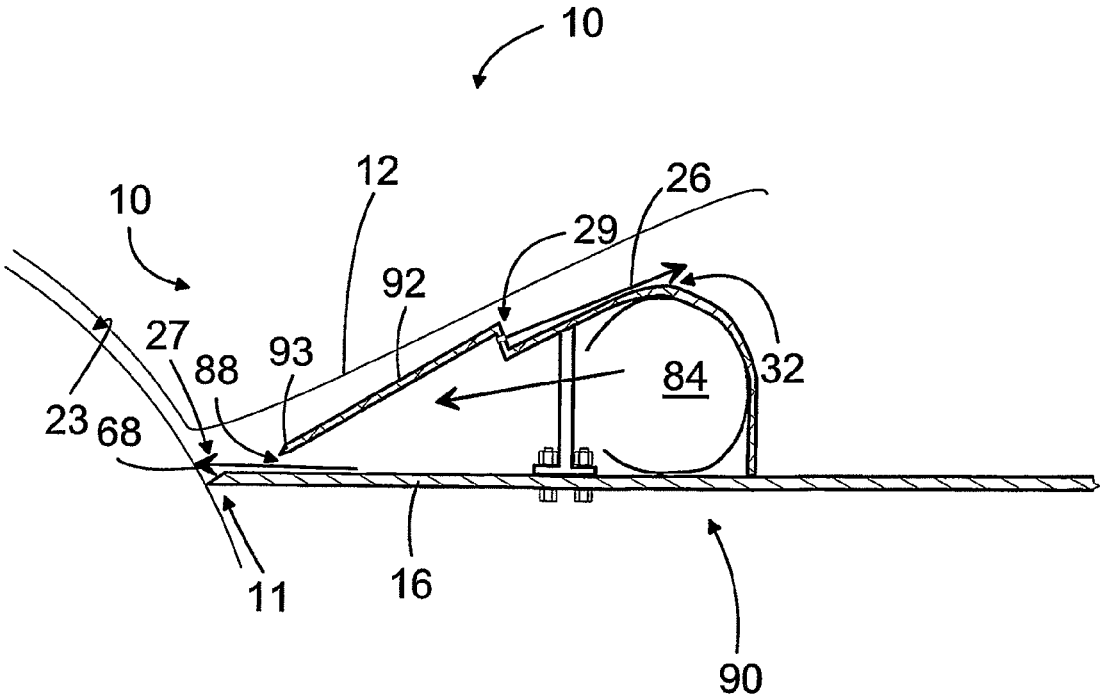
FIG. 9 shows another slit nozzle casing in connection with a mechanical blade.

The doctor apparatus 10 shown in FIG. 9 is used to detach a web threading tail 12 from a moving surface 23 by means of an air blade 68 included in the release means 11 for the web threading tail 12. The air blade 68 is formed by a blow-off blow 27 coming from a blow-off blow slit 88. The doctor apparatus also includes trailing blow means 29 which are used to direct a trailing blow 26 to the web threading tail 12. The trailing blow means 29 are used to blow the trailing blow 26 substantially to the same direction with the flow surface 32.

A slit nozzle casing 90 is provided in connection with the mechanical blade 16 of the doctor apparatus shown in FIG. 9. The mechanical blade 16 is included in the release means 11 for the web threading tail 12. The slit nozzle casing 90 includes a first wall 92, which is a cover surface. A blow-off blow slit 88 is provided between the first wall 92 and the mechanical blade 16. The slit nozzle casing 90 is composed of a first wall 92 and a pipe 84 located in connection with it, which are removable from the mechanical blade 16. Thus the slit nozzle casing 90 can be used in connection with many mechanical blades 16. Advantageously, the first wall 92 is adapted to bend when pressurizing the slit nozzle casing 90 whereby the blow-off blow slit 88 is adapted to be formed. As the air-blow slit is formed during pressurization of the gap between the first wall 92 and the mechanical blade 16, the air-blow slit 88 does not exist in the unpressurized state. Then dirt cannot access the slit nozzle casing in the unpressurized state. In the pressurized state, in turn, air flows from the slit nozzle casing whereby dirt or impurities cannot access it.

Figure 10A:
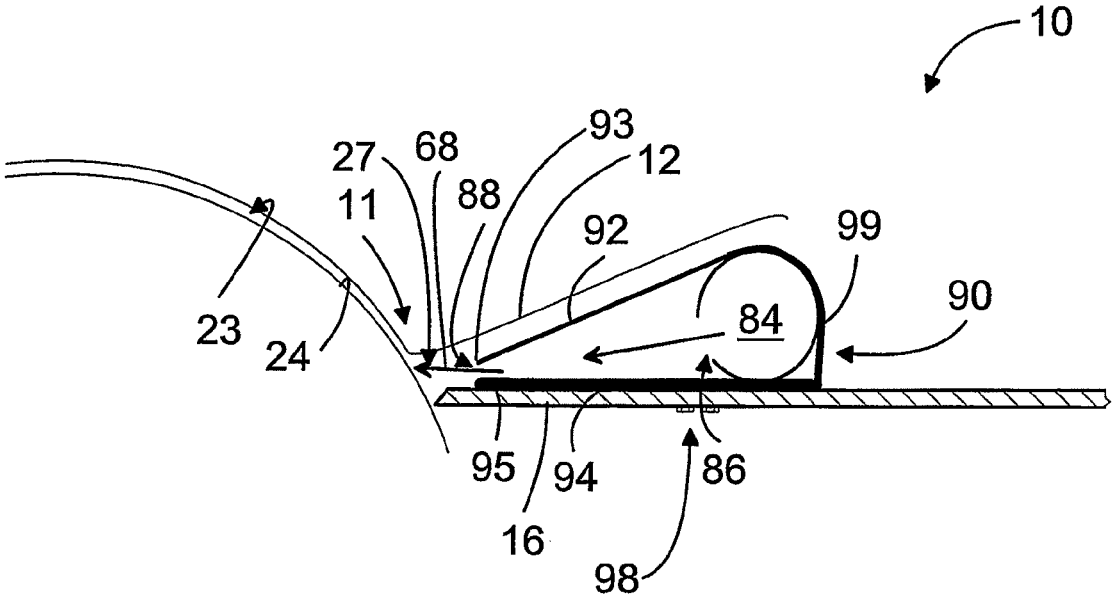
FIG. 10*a* shows a third slit nozzle casing in connection with a mechanical blade.
Figure 10B:
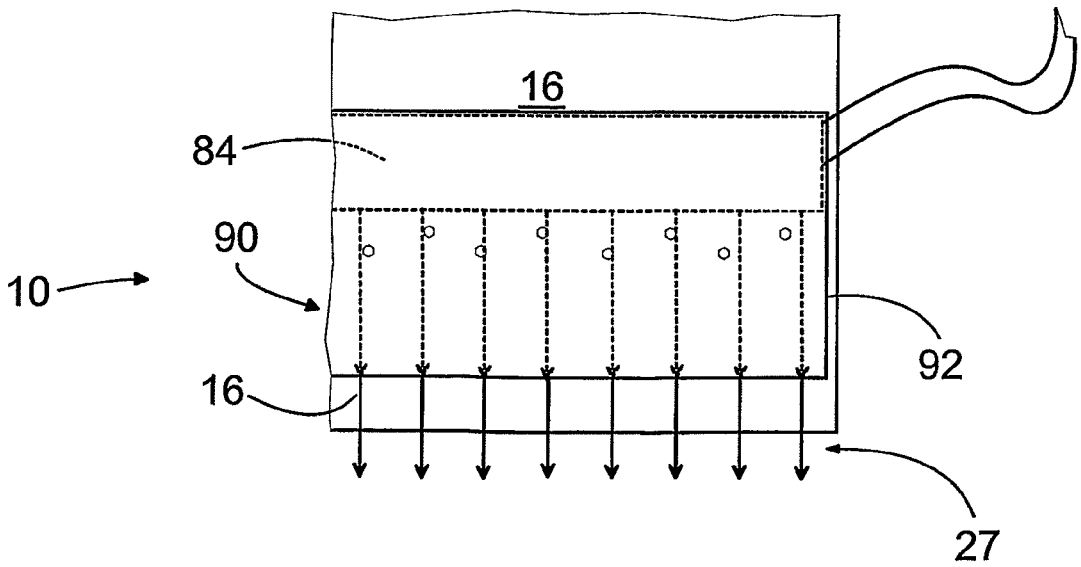
FIG. 10*b* shows the mechanical blade of FIG. 10*a* as seen from the side of the slit nozzle casing.
Figure 4:
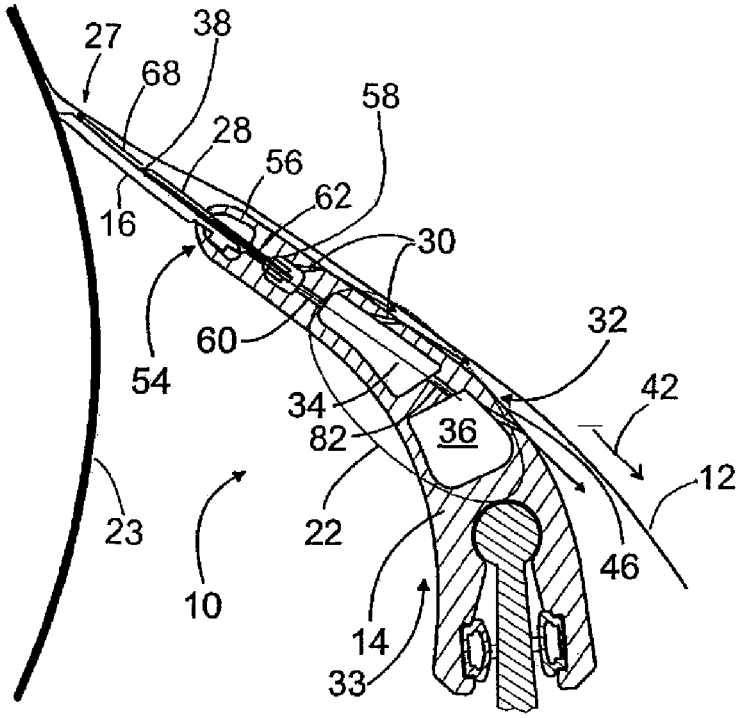
Figure 5:
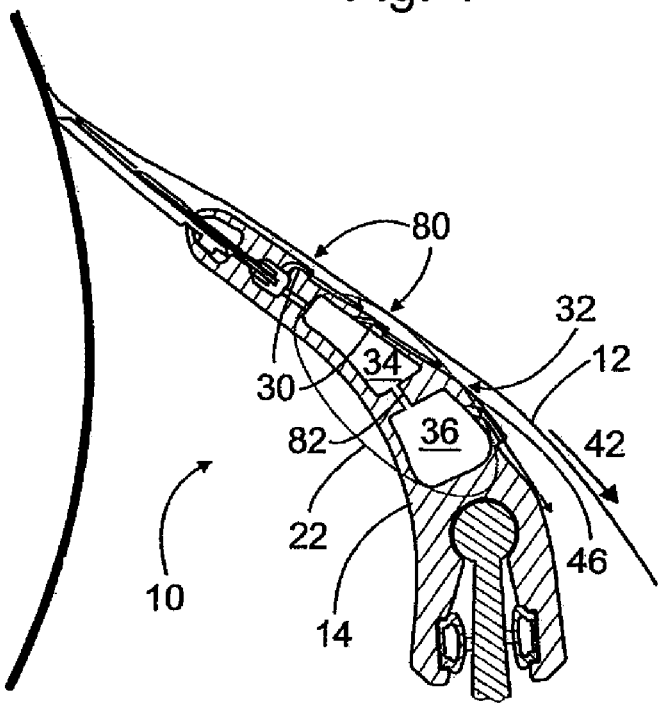

FIG. 10*a* is a cross-sectional view of the doctor apparatus 10 seen from the end of the mechanical blade 16. FIG. 10*b*, in turn, shows the same doctor apparatus 10 seen from above the mechanical blade 16. In the doctor apparatus shown in FIG.

10*a*, a pipe 84 is supplied with pressurized air which is led uniformly into a slit nozzle casing 90 through an opening 86 in the pipe 84. As the pressure increases, a blow-off blow slit 88 is created between the first wall 92 or the cover surface and the second wall 94 or the bottom surface. In other words, when the slit nozzle casing 90 is pressurized, the first wall 92 of the slit nozzle casing 90 bends. Then the blow-off blow 27 can pass through the blow-off blow slit 88 created between the first wall 92 and the mechanical blade 16. The blow-off blow slit 88 is created when the slit nozzle casing 90 is in the pressurized state. A slit nozzle casing that forms a blow-off blow slit 88 when pressurized does not get soiled in the unpressurized state.

The slit nozzle casing 90 shown in FIG. 10*a* includes a second wall 94, whereby the pressure opening the air-blow slit 88 affects between the first wall 92 and the second wall 94 of the slit nozzle casing 90. Then a direct pressure is not applied to the blade at the slit nozzle casing. Advantageously, the second wall 94 is more rigid than the first wall 92, whereby the first wall bends as desired when pressurizing the slit whereas the second wall is non-bending. In this way forces affecting the load are not directed to the mechanical blade. More generally, the first wall 92 included in the doctor apparatus is adapted to bend when pressurizing the slit nozzle casing 90 whereby a blow-off blow slit 88 is adapted to be formed.

The slit nozzle casing 90 shown in FIG. 10*a* set in connection with a mechanical blade is fastened to the mechanical blade 16 by its second wall 94 with an openable connection 98. Fastening the slit nozzle casing is particularly simple when it is performed via the non-bending second wall 94.

The first wall 92 of the slit nozzle casing 90 shown in FIG. 10*a* has a front edge 93 and the second wall 94 has a front edge 95. The front edges 93, 95 extend towards the tip of the mechanical blade 16, by which the roll surface 24 is doctored, forming a very narrow blow-off blow slit 88. The blow-off blow 27 passes through the blow-off blow slit 88 located between the first wall 92 and the mechanical blade 16. The first wall 92 and the second wall 94 are sealed against each other when the slit nozzle casing is unpressurized. When the second wall is missing, the front edge 93 of the first wall 92 is sealed against the mechanical blade 16 (FIG. 9).

In FIG. 10*b*, the doctor apparatus of FIG. 10*a* is shown from outside the slit nozzle casing 90, on the side of the first wall 92. The mechanical blade 16 is drawn partly with a broken line since the mechanical blade 16 is behind the slit nozzle casing 90. Correspondingly, the pipe 84 inside the slit nozzle casing 90 is drawn with a broken line, being located behind the first wall 92. A blow-off blow 27 comes from the slit nozzle casing 90. The slit nozzle casing can be equal in dimension with the entire blade or it can cover only the width of the web threading tail.

In the doctor apparatus 10 shown in FIG. 10*a*, the slit nozzle casing 90 has a rear edge 99. An openable connection 98 is closer to the rear edge 99 of the slit nozzle casing 90 than to the front edge 93 of the first wall 92 of the slit nozzle casing. Then the blow-off blow 27 is correctly directed also when the slit nozzle casing is pressurized since the air-blow slit opens when the cover surface bends while the mechanical blade does not bend. The second wall or the bottom surface of the slit nozzle casing is machined plane in order that the slit nozzle casing seals against the surface of the mechanical blade. The ends of the slit nozzle casing are also sealed with labyrinth seals, for example, which prevent air-blows in the cross-machine direction within the casing. Advantageously, a rubber seal that completely prevents an air-blow from the end is placed in the outermost labyrinth.

We claim:

1. A blade holder in a fiber web machine for detaching a web threading tail from a moving surface, comprising:

a frame formed as a single one piece integral profile;

a mechanical doctor blade removably mounted to the frame and defining a direction in which the doctor blade extends toward and engages the moving surface;

portions of the frame forming a first integral air channel within the integral profile of the frame, the first integral air channel extending in the cross-direction, and a plurality of machine-directional blow-off blow channels extending from the first integral air channel and which are arranged to direct air substantially in the same direction in which the doctor blade extends, so as to generate blow-off blows which detach the web threading tail from the moving surface of the fiber web machine;

a flow surface formed integral with the frame and extending in a direction away from the moving surface; and portions of the frame forming a second integral air channel extending in the cross-direction, and portions of the frame forming a plurality of machine-directional bores which form first trailing blow channels arranged to direct air in the same or substantially the same direction in which the flow surface extends so as to generate trailing blows for guiding the web threading tail relative to the flow surface.

2. The blade holder of claim 1 further comprising:

a plurality of flow supports;

each flow support having a flow surface defining a flow direction and portions forming trailing blow channels which direct air flowing therefrom in the same or substantially in the same direction as defined by the flow surface to maintain the web threading tail in guiding connection with said flow supports;

wherein a first flow support of the plurality of flow supports is mounted to the frame, and wherein the plurality of flow supports are connected to each other and the frame to form a sequence of flow supports forming a flow surface of a selected length extending from the blade holder.

3. The blade holder of claim 1 further comprising:

a presser device forming part of the frame loading the mechanical doctor blade against the frame, and wherein the blow-off blow channels are formed by portions of the frame and are adjacent the presser device.

4. The blade holder of claim 1 further comprising:

a presser device loading the mechanical doctor blade against the frame, and wherein the blow-off blow channels are between the presser device and the mechanical doctor blade.

5. The blade holder of claim 1 further comprising:

a pivotal mounting attached to the frame opposite the mechanical doctor blade and after the trailing blow channels.

6. The blade holder of claim 1 further comprising: portions of the frame forming a third integral air channel extending in the cross-direction, and portions of the frame forming a second plurality of trailing blow channels extending to the third integral air channel and spaced from the first blow-off blow channels in the extending direction of the flow surface so as to generate trailing third blows for guiding the web threading tail relative to the flow surface.

7. The blade holder of claim 1 further comprising: a guide surface formed by portions of the frame between the blow-off blow channels and the first trailing blow channels.

8. The blade holder of claim 7 wherein the guide surface is substantially planar.

9. The blade holder of claim 1 wherein an angle of over 130° is defined between the blow-off blows defined by the blow-off blows channels and the first trailing blows defined by the first trailing blow channels.

10. The blade holder of claim 1 wherein an angle of over 150° is defined between the blow-off blows defined by the blow-off blows channels and the first trailing blows defined by the first trailing blow channels.

11. The blade holder of claim 1 wherein the single one piece integral profile is made of aluminum.

12. The blade holder of claim 11 wherein the single one piece integral profile is made of an aluminum casting.

13. The blade holder of claim 1 wherein the first integral air channel and the second integral air channel are connected by portions of the frame which form a flow opening therebetween.

14. A blade holder in a fiber web machine for detaching a web threading tail from a moving surface, comprising:

a frame formed as a single one piece integral profile;

a mechanical doctor blade removably mounted to the frame and defining a direction in which the doctor blade extends toward and engages the moving surface;

wherein the frame has portions forming a flow surface, downstream of the doctor blade in a machine direction;

portions of the frame forming at least one air channel within the integral profile of the frame, the air channel extending in a cross-direction, and portions of the frame forming a plurality of machine-directional bores each of which forms an acute angle with respect to a portion of the flow surface which each bore joins, in the machine direction and which bores form nozzle channels extending to said at least one air channel, the nozzle channels being arrayed in a cross machine-direction to form trailing blows arranged to direct air along the flow surface in the machine direction for guiding the web threading tail along the flow surface.

15. The blade holder of claim 14 wherein the air channel comprises a plurality of pressure chambers and a blade groove connected by flow channels, and said portions of the frame forming the plurality of machine-directional bores form nozzle channels extending to one of the plurality of pressure chambers and the blade groove, the nozzle channels being arrayed in the cross machine-direction to form a plurality of rows of trailing blows arranged to direct air along the flow surface in the machine direction for guiding the web threading tail along the flow surface.

16. The blade holder of claim 14 wherein each of the plurality of machine-directional bores is straight, such as can be formed by drilling, and each bore forms an acute angle in the machine direction with respect to a portion of the flow surface which each bore joins.

17. The blade holder of claim 15 wherein the portion of the flow surface which each nozzle channel joins is smoothly continuous except for the actual bore opening of each nozzle channel through the flow surface.

18. The blade holder of claim 17 wherein the portion of the flow surface which the nozzle channels joins is flat for two rows of the plurality of rows of trailing blows.

19. The blade holder of claim 14 wherein the frame has a structure formed by casting.

20. The blade holder of claim 14 wherein the frame has a maximum thickness of less than 100 mm between the flow surface and an outside surface opposite the flow surface.

21. The blade holder of claim 14 wherein portions of the frame form at least one presser plate chamber within the integral profile of the frame, the presser plate chamber extending in the cross-direction; and a presser plate extending through the at least one presser plate chamber, the presser plate chamber forming a plurality of machine-directional blow-off blow channels arranged to direct air substantially in the same direction in which the doctor blade extends, so as to generate blow-off blows which detach the web threading tail from the moving surface of the fiber web machine.

22. The blade holder of claim 14 wherein the single one piece integral profile is made of aluminum.

* * * * *

UNITED STATES PATENT AND TRADEMARK OFFICE

CERTIFICATE OF CORRECTION

PATENT NO. : 8,221,589 B2
APPLICATION NO. : 12/874663
DATED : July 17, 2012
INVENTOR(S) : Auranen et al.

It is certified that error appears in the above-identified patent and that said Letters Patent is hereby corrected as shown below:

Delete the title page showing an illustrative figure and substitute the attached title page therefor.

On the Title page, Item (73) of the issued patent, the Assignee, "Metson Paper, Inc.," should be -- Metso Paper, Inc., --.

On the Title page, Item (56) of the issued patent, under FOREIGN PATENT DOCUMENTS, "DD 3941242 A1 6/1991" should be -- DE 3941242 A1 6/1991 --.

On the Title page, Item (56) of the issued patent, under FOREIGN PATENT DOCUMENTS, "FI 20072808 11/2007" should be -- FI 20075808 11/2007 --.

In the drawings, delete sheet 7/11, Fig. 4 and substitute the attached drawing sheet with Fig. 4 submitted as part of the amendment submitted on March 22, 2012.

Signed and Sealed this
Eleventh Day of September, 2012

David J. Kappos

David J. Kappos
*Director of the United States Patent and Trademark Office*

(12) United States Patent
Auranen et al.

(10) Patent No.: US 8,221,589 B2
(45) Date of Patent: Jul. 17, 2012

(54) METHOD, A BLADE HOLDER AND A DOCTOR APPARATUS FOR DETACHING A WEB THREADING TAIL FROM A MOVING SURFACE IN A FIBER WEB MACHINE

(75) Inventors: Tuomo Pekka Auranen, Vaajakoski (FI); Reijo Hassinen, Leppävesi (FI); Veli-Pekka Koljonen, Kärnä (FI); Kari-Matti Laitinen, Jyväskylä (FI); Pekka Meriläinen, Jyväskylä (FI); Anssi Toivanen, Palokka (FI)

(73) Assignee: Metson Paper, Inc., Helsinki (FI)

( * ) Notice: Subject to any disclaimer, the term of this patent is extended or adjusted under 35 U.S.C. 154(b) by 0 days.

(21) Appl. No.: 12/874,663

(22) Filed: Sep. 2, 2010

(65) Prior Publication Data

US 2010/0325912 A1 Dec. 30, 2010

Related U.S. Application Data

(63) Continuation of application No. 12/742,889, filed as application No. PCT/FI2008/050649 on Nov. 11, 2008, now abandoned.

(30) Foreign Application Priority Data

Nov. 14, 2007 (FI) ..... 20075808

(51) Int. Cl.
*B31F 1/12* (2006.01)

(52) U.S. Cl. ..... 162/281; 34/117

(58) Field of Classification Search ..... 162/281, 162/280, 352; 34/117; 15/256.51
See application file for complete search history.

(56) References Cited

U.S. PATENT DOCUMENTS

| | | | |
|---|---|---|---|
| 1,595,478 | A | 8/1926 | Minton |
| 4,014,487 | A | 3/1977 | Reba et al. |
| 5,987,777 | A | 11/1999 | Goebel et al. |
| 6,145,217 | A | 11/2000 | Goebel |

FOREIGN PATENT DOCUMENTS

| | | | |
|---|---|---|---|
| CA | 2144623 | A1 | 3/1995 |
| DD | 3941242 | A1 | 6/1991 |
| EP | 0479748 | A1 | 4/1992 |
| FI | 119389 | | 10/2004 |
| FI | 20030619 | | 10/2004 |
| FI | 20072808 | | 11/2007 |
| GB | 200600 | | 7/1923 |
| WO | 9002225 | A1 | 3/1990 |
| WO | 9723690 | A1 | 7/1997 |
| WO | 2004094723 | A1 | 11/2004 |
| WO | 2009063132 | A1 | 5/2009 |

OTHER PUBLICATIONS

Written Opinion of the International Searching Authority for PCT/FI2008/050649.
International Search Report for PCT/FI2008/050649.

*Primary Examiner* — Mark Halpern
(74) *Attorney, Agent, or Firm* — Stiennon & Stiennon

(57) ABSTRACT

In a method for detaching a web threading tail from a moving surface in a fiber web machine, the web threading tail (12) is detached from a moving surface (23) by means of air that flows from a blow-off blow channel (19) included in a blade holder (14). A trailing blow (26) is directed to the web threading tail (12) using air that flows from a trailing blow channel (17) included in the blade holder (14). The blade holder (14) includes a flow surface (32), and the trailing blow (26) is blown to the same direction with or in a small angle relative to the flow surface (32). The invention also relates to a corresponding blade holder and a doctor apparatus for detaching a web threading tail from a moving surface in a fiber web machine.

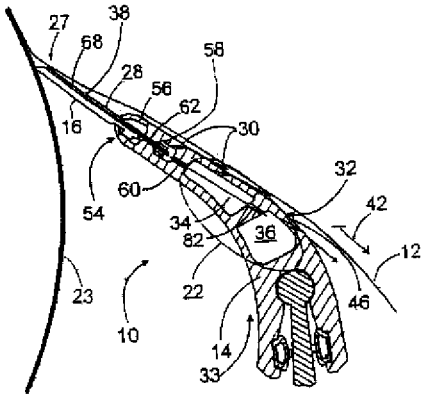

22 Claims, 11 Drawing Sheets